US007419067B2

(12) United States Patent
Bouie et al.

(10) Patent No.: US 7,419,067 B2
(45) Date of Patent: Sep. 2, 2008

(54) CUP AND LID COMBINATION

(75) Inventors: Tony Bouie, Anthem, AZ (US); Ray Zuckerman, Scottsdale, AZ (US)

(73) Assignee: Halo Cups, Inc., Anthem, AZ (US)

( * ) Notice: Subject to any disclaimer, the term of this patent is extended or adjusted under 35 U.S.C. 154(b) by 0 days.

(21) Appl. No.: 11/544,268

(22) Filed: Oct. 6, 2006

(65) Prior Publication Data

US 2007/0029320 A1 Feb. 8, 2007

Related U.S. Application Data

(63) Continuation-in-part of application No. 11/442,020, filed on May 25, 2006, which is a continuation-in-part of application No. 11/297,959, filed on Dec. 8, 2005, which is a continuation-in-part of application No. 10/763,520, filed on Jan. 23, 2004, now abandoned.

(51) Int. Cl.

| | |
|---|---|
| ***B65D 43/08*** | (2006.01) |
| ***B65D 55/16*** | (2006.01) |
| *B65D 43/03* | (2006.01) |
| *B65D 43/16* | (2006.01) |
| *B65D 51/04* | (2006.01) |

(52) U.S. Cl. ..... 220/379; 220/375; 220/781; 220/834; 220/842

(58) Field of Classification Search ..... 220/375, 220/23.4, 213, 781, 379, 675, 713, 744, 23.83, 220/735, 717, 831, 832, 837, 839, 834, 842; 206/515, 514, 501; D7/509, 511; 215/306, 215/390

See application file for complete search history.

(56) References Cited

U.S. PATENT DOCUMENTS

| | | | | | |
|---|---|---|---|---|---|
| 1,755,086 | A | * | 4/1930 | Tapp | 81/3.09 |
| 3,069,046 | A | * | 12/1962 | Gram | 215/383 |
| 3,393,826 | A | * | 7/1968 | Brown | 206/520 |
| 3,534,736 | A | * | 10/1970 | Meyers | 604/78 |
| 3,810,470 | A | | 5/1974 | Von Gunten | |
| 3,841,528 | A | * | 10/1974 | Eisenberg | 222/143 |
| 3,900,106 | A | | 8/1975 | Cantales | |
| D240,285 | S | | 6/1976 | Sarpaneva | |
| 4,043,478 | A | * | 8/1977 | Duncan | 220/710 |
| 4,082,201 | A | * | 4/1978 | Bittel | 220/834 |
| 4,420,092 | A | | 12/1983 | Finkelstein | |
| 4,573,631 | A | * | 3/1986 | Reeves | 229/404 |
| 5,050,759 | A | | 9/1991 | Marble | |
| 5,244,106 | A | | 9/1993 | Takacs | |
| 5,407,098 | A | | 4/1995 | Tomer | |
| 5,460,264 | A | | 10/1995 | Rupert | |
| 5,605,241 | A | | 2/1997 | Imperioli | |
| 5,645,191 | A | * | 7/1997 | Neville | 220/717 |
| D389,700 | S | | 1/1998 | Bingham | |
| 5,897,010 | A | | 4/1999 | Soyka et al. | |
| 6,047,852 | A | | 4/2000 | Evans et al. | |
| D434,943 | S | * | 12/2000 | Price | D7/509 |

(Continued)

*Primary Examiner*—Anthony D Stashick
*Assistant Examiner*—Niki M. Eloshway
(74) *Attorney, Agent, or Firm*—Jeffer Mangels Butler & Marmaro LLP

(57) ABSTRACT

A cup and lid in combination. The cup includes a side wall, a closed bottom and an open top. One of the side wall and the lid includes a recess defined therein, and the other of the side wall and the cup lid includes a connector that is adapted to be temporarily secured in the recess.

16 Claims, 21 Drawing Sheets

U.S. PATENT DOCUMENTS 6,164,488 A * 12/2000 Solland et al. ..... 220/834
6,176,420 B1 1/2001 Sarson et al.
D446,687 S 8/2001 Furman et al.
D461,098 S 8/2002 Lin
6,502,713 B1 * 1/2003 Baker ..... 220/523
D474,367 S 5/2003 Turchi et al.
D477,183 S 7/2003 Janky
D479,946 S 9/2003 Jalet et al.
D480,601 S 10/2003 Pettaweebuncha
6,688,469 B1 2/2004 Barnes
D507,458 S 7/2005 Allen et al.
D507,932 S 8/2005 Cintron et al.
D507,934 S 8/2005 Featherston et al.
D514,884 S 2/2006 Smith et al.
D519,782 S 5/2006 Schuler et al.
D523,692 S 6/2006 Meehan
D529,761 S 10/2006 Trombly
D530,569 S 10/2006 Hsu
D530,980 S 10/2006 Zerillo et al.
D531,854 S 11/2006 Bresler
D533,748 S 12/2006 Bresler
D535,520 S 1/2007 Cundieff
D537,677 S 3/2007 Bresler

* cited by examiner

DETAIL B

CUP AND LID COMBINATION

This is a continuation-in-part of application Ser. No. 11/442,020, filed on May 25, 2006, which is a continuation-in-part of application Ser. No. 11/297,959, filed on Dec. 8, 2005, which is a continuation-in-part of application Ser. No. 10/763,520, filed on Jan. 23, 2004, now abandoned, the entireties of which are incorporated herein by reference.

FIELD OF THE INVENTION

This invention is concerned with improving the handling of nestable cups and lids for those cups.

BACKGROUND OF THE INVENTION

It is customary to configure disposable soft drink cups so that each cup can be nested in a like cup beneath it in a stack. This greatly reduces the storage space for multiple cups. Such cups are rarely supplied with lids in place on the open mouth of the cups because this would preclude the cups being nested. Hence, the lids are usually supplied and stored in a container separate from the container for the cups. And, thus, the cups and lids must be handled separately and brought together for use.

In the prior art U.S. Pat. No. 6,176,420, granted Jan. 23, 2001 to G. E. Sarson et al. for "Disposable Cup With Spill Resistant Lid" proposes to configure the cup with an integral lid that can be folded between a raised position and a semi-closed position. The construction does not allow the cup opening to be fully and reliably closed.

P. S. Takacs in his U.S. Pat. No. 5,244,106, granted Sep. 14, 1993 for "Bottle Incorporating Cap Holder" proposed to store the cap for a bottle in a recess in the base of the bottle. Of course, such an arrangement is not nestable with other like bottles.

U.S. Pat. No. 6,047,852 granted Apr. 11, 2000 to M. G. Evans et al. for "Hot Beverage Lid With Thermal Flex-Guards" proposed attaching the lid to flaps or a cylinder of heat insulating material at the wall of the cup. Again, if the cups are nested for storage the lid must be stored and handled separately.

There continues to be a need for a cup and lid combination in which these items can be stored together in a nested condition.

There continues to be a need for a cup and lid combination in which these items can be stored together in a nested condition.

SUMMARY OF THE PREFERRED EMBODIMENTS

This invention proposes to provide a recess in the frustroconical wall of a nestable cup to house and retain for use a lid for the cup. The wall of the cup is preferably configured to releasably retain the lid in the recess. There may also be provided a flexible tether connecting the lid to the cup so the lid does not fall free of the cup when removed from the recess. Further, the lid may be provided with a tab to facilitate removal of the lid from the recess.

In accordance with another aspect of the present invention, there is provided a cup and lid combination that includes a cup having a side wall, a closed bottom and an open top, a lid configured to close the open top of the cup, and a tether connecting the lid to the cup. In a preferred embodiment, the cup includes a band extending therearound, and one end of the tether is connected to the band, and the other end of the tether is connected to the lid. Also, the top of the cup preferably has a convex/concave shape.

In accordance with another aspect of the present invention, there is provided a method of placing a lid on a nestable cup, the cup including a flexible tether connected at one end to the cup and at the opposite end to the lid. The method includes the steps of providing a stack of nestable cups, at least a first cup including a lid in a storage position, removing the first cup from the stack, and moving the lid from the storage position to a use position. In a preferred embodiment, the cup further includes a band extending therearound and the tether is connected at one end to the band and at the opposite end to the lid. The method can also include the step of tearing the tether, thereby separating the lid from the band.

In accordance with another aspect of the present invention, there is provided a top for a cup including a band, a lid, and a tether having its first end secured to the band and its second end secured to the lid. In a preferred embodiment, the band has a channel defined therein and includes a bottom portion and a lip extending outwardly from the bottom portion. The channel is defined in the bottom portion.

In accordance with yet another aspect of the present invention, there is provided a cup including a side wall, a closed bottom and an open top. Preferably the side wall includes an indented portion and a raised portion that cooperate to define a slot portion that is adapted to receive a lid. The lid can be slid into and retained in the slot portion. In a preferred embodiment the raised portion includes at least one flange that partially defines and extends about the periphery of the slot portion.

In accordance with still another aspect of the present invention, there is provided a method of storing a lid. The method includes the steps of providing a cup that has a side wall having a slot portion defined therein, a closed bottom and an open top, providing a lid, and sliding the lid into the slot portion. In a preferred embodiment, the side wall includes at least one flange that partially defines the slot portion and a mouth, and the step of sliding the lid into the slot portion includes inserting the lid through the mouth and sliding the lid under the at least one flange.

In accordance with another aspect of the present invention, there is provided a method of placing a lid on a cup. The method includes a first step of providing a stack of nestable cups, at least one of the cups including a side wall having a slot portion defined therein, a closed bottom and an open top. A lid is disposed in the slot portion. The method also includes the steps of removing the at least one cup from the stack, sliding the lid out of the slot portion, and placing the lid on the top of the cup.

In accordance with another aspect of the present invention, there is provided a cup and lid in combination. The cup includes a side wall, a closed bottom and an open top and one of the side wall and the lid includes a recess defined therein, and the other of the side wall and the cup lid comprising a connector that is adapted to be temporarily secured in the recess. In a preferred embodiment, the recess includes a pair of opposed knobs that define a distance therebetween and the connector includes an extension having a width. The width of the extension is less than the distance between the opposing knobs. In another preferred embodiment, the protrusion has a pair of indentations defined on opposed sides thereof, and the connector includes a U-shaped member that has elongated ridges on an inside surface thereof that are received in the indentations on the protrusion. The protrusion includes a blocker that abuts a bottom edge of the U-shaped member.

In accordance with yet another aspect of the present invention, there is provided a method of placing a lid on a cup. The method includes the step of providing a stack of nestable cups and lids. At least one of the cups includes a side wall, a closed bottom and an open top, the side wall has a recess defined therein, and the lid has a connector that is received in the recess. The method further comprises the steps of removing the at least one cup from the stack, removing the connector from the recess, and placing the lid on the top of the cup.

BRIEF DESCRIPTION OF THE DRAWINGS

The invention is described in greater detail hereinafter by reference to the accompanying drawings wherein.

DETAILED DESCRIPTION OF THE PREFERRED EMBODIMENTS

Figure 1:
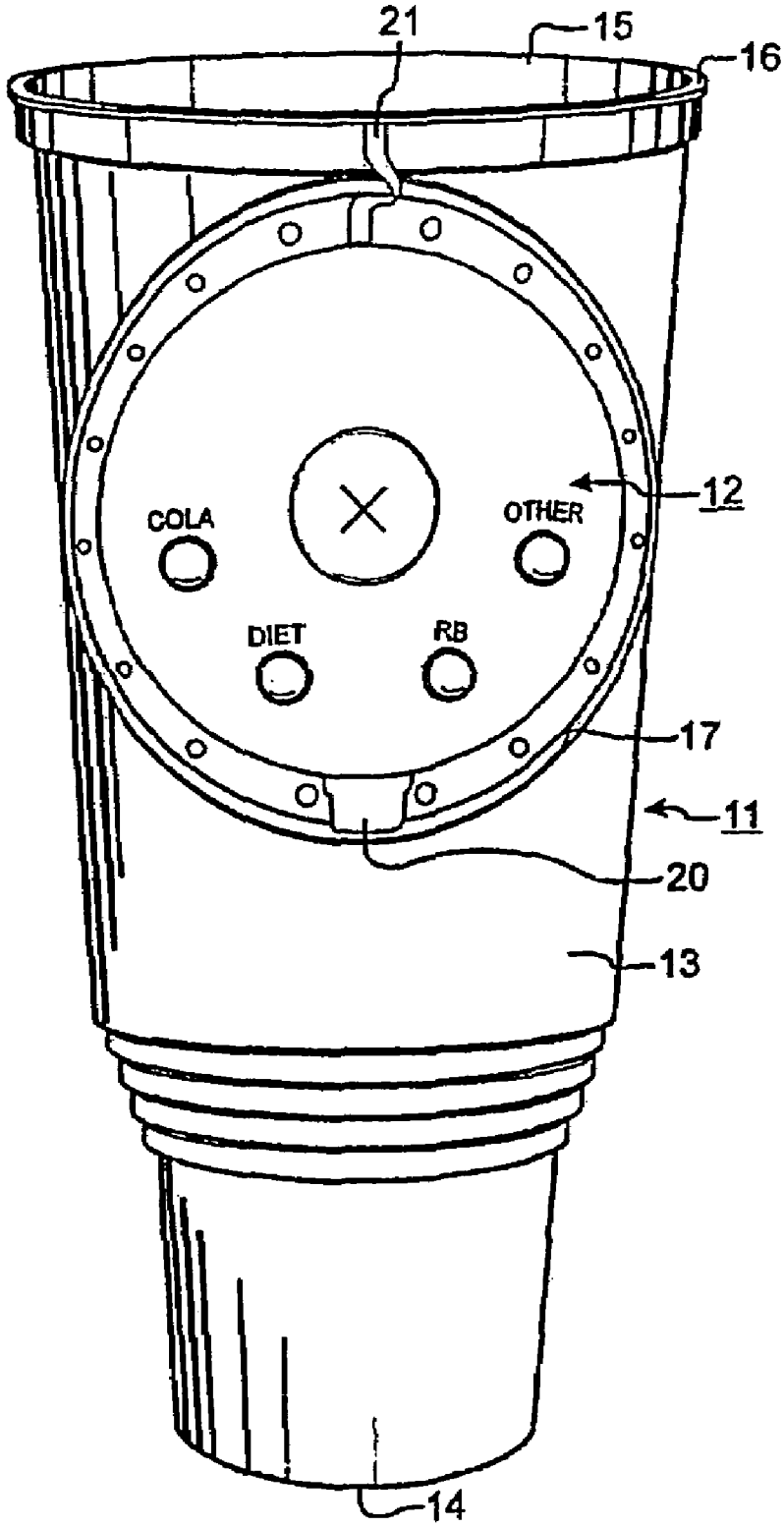
FIG. 1 is an elevational view of a first embodiment of a cup/lid combination incorporating this invention.
Figure 2:
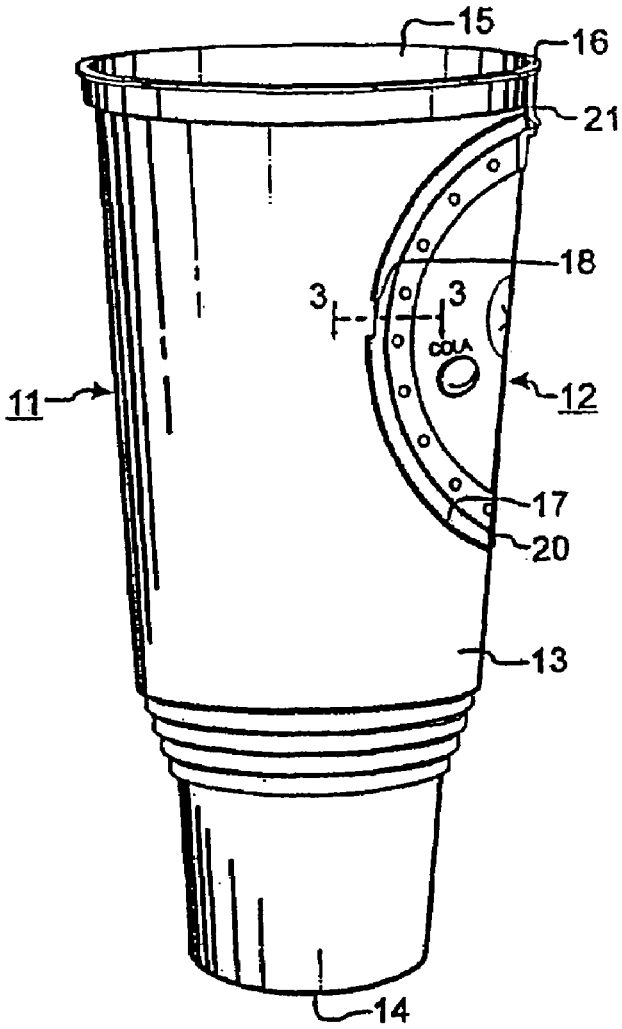
FIG. 2 is a side elevational view of the cup/lid combination of FIG. 1.
Figure 3:
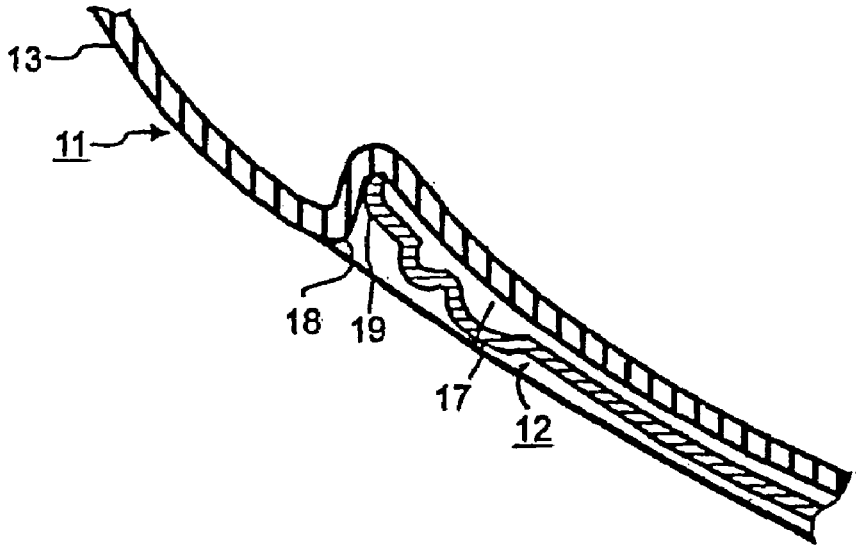
FIG. 3 is an enlarged partial sectional view of the cup/lid combination of FIG. 1 taken generally as indicated by line 3-3 in FIG. 2.

Referring to FIGS. 1-3, the numeral 11 designates generally the cup and numeral 12 designates generally the lid for the cup.

For exemplary purposes only, described hereinbelow is a preferred embodiment wherein the cups described are of a nestable variety. However, this is not a limitation on the present invention. It will be understood that the cup/lid combinations taught herein can by used with any type of cup or vessel that includes a lid. Other uses for the cup/lid combinations described herein will be readily apparent to those skilled in the relevant art.

It will be appreciated that terms such as "top," "bottom," "side," "upwardly" and other such descriptive terms used hereinbelow are merely for ease of description and refer to the orientation of the components as shown in the figures. It should be understood that any orientation of the cup/lid combinations described herein is within the scope of the present invention.

Cup 11 is a nestable variety, meaning that it can be stacked with a cup nesting inside a cup therebeneath in a stack. To this end cup 11 has a frustroconical wall 13 with a closed bottom 14 and an open top 15. The cup preferably has a thickened or rolled lip 16 at the open top 15.

The wall 13 of cup 11 has a circular recess 17 therein for receiving the lid 12. In the view of the recess 17 there are provided one or more pairs of oppositely disposed nubs 18 which are adapted to overlie and retain the periphery 19 of the lid 12 when it is positioned within recess 17. (Only one such nub 18 is shown in the drawings at FIG. 2 and in enlarged section in FIG. 3.)

Both the cup 11 and the lid 12 are preferably formed of thin wall flexible plastic materials thus enabling the lid 12 to be bent and flexed in placing it in recess 17 beneath cup nubs 18 and to likewise flex when the lid 12 is snapped out of the recess 17 for use in covering the open top 15 of the cup.

If desired a tab 20 may be affixed to or be integral with the lid 12 to facilitate removing the lid from the cup wall recess 17.

Also, if desired the combination may include a flexible tether 21 providing a connection between the lid and the cup. The tether 21 prevents the lid from flying free when it is pulled from the recess 17 in the cup wall 13.

From the foregoing it should be apparent that with the cup lid 12 nestled within the recess 17 of the cup wall 13 the cup and lid can be nested within another like cup/lid combination for stacked storage and dispensing.

In another embodiment, the recess 17 can include a lip, similar to lip 16 for retaining the lid 12. In this embodiment, instead of being nestled within recess 17, the lid 12 is snap fit onto the lip within recess 17, just as it is typically snap fit onto lip 16 when in use. In this embodiment, the cups are still nestable because the lip is located within recess 17. In use, the lid 12 is removed from the lip in recess 17 and is then placed on lip 16. In yet another embodiment, recess 17 can be omitted, and a lip for retaining lid 12 can be formed on the side wall 13 of cup 11.

Figure 4:
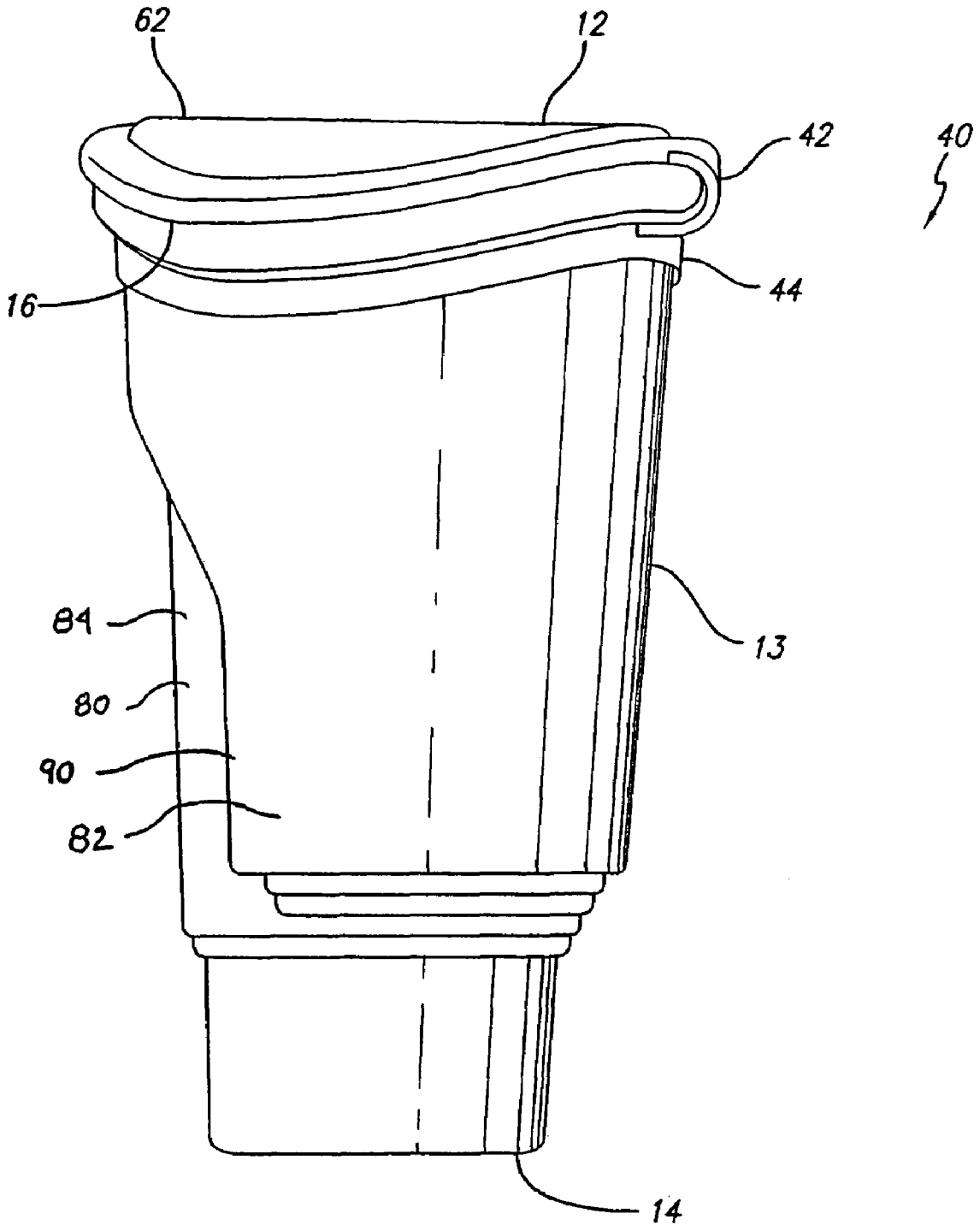
FIG. 4 is a perspective view of a second preferred embodiment of a cup/lid combination.
Figure 5:
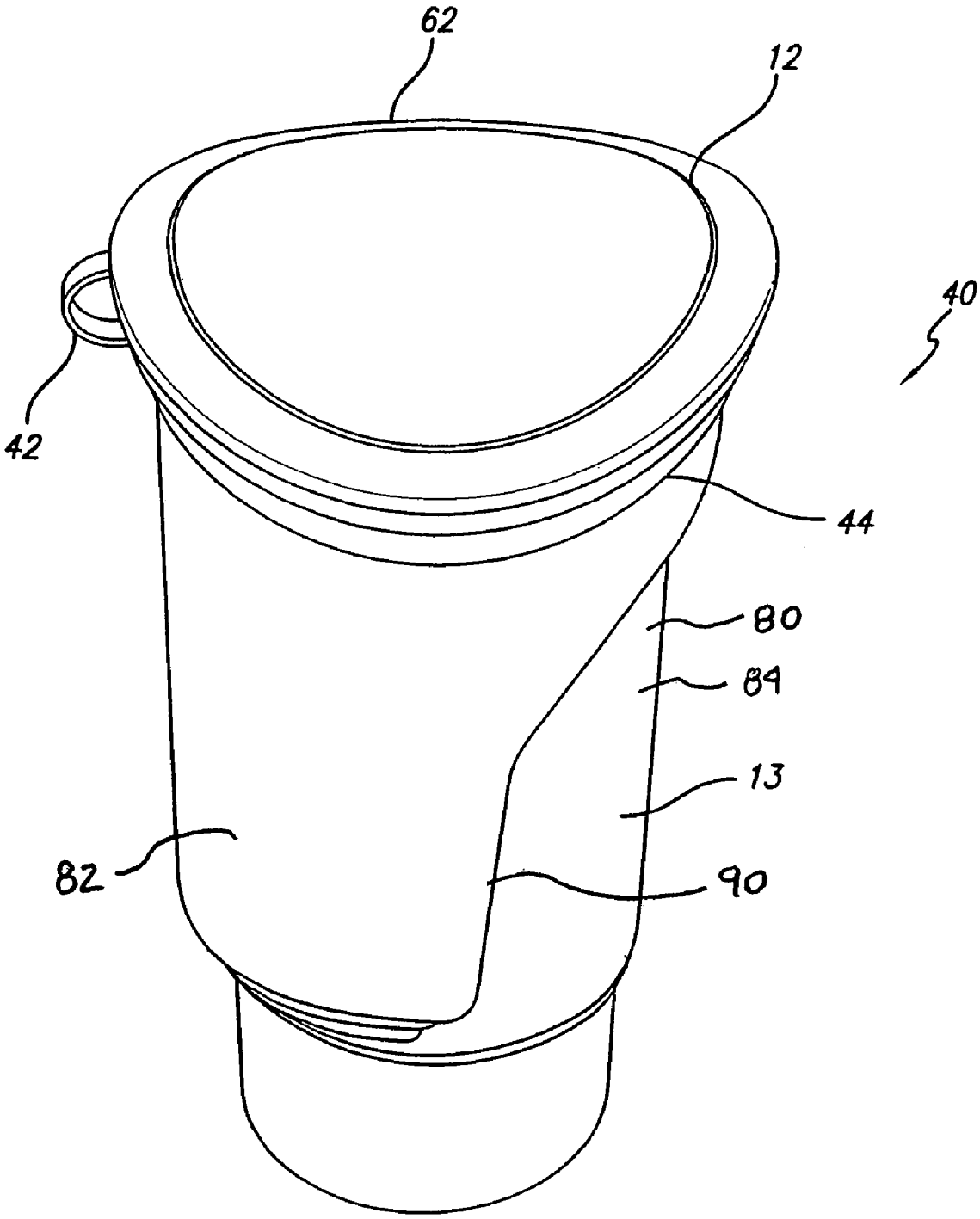
FIG. 5 is another perspective view of the cup/lid combination of FIG. 4.
Figure 6:
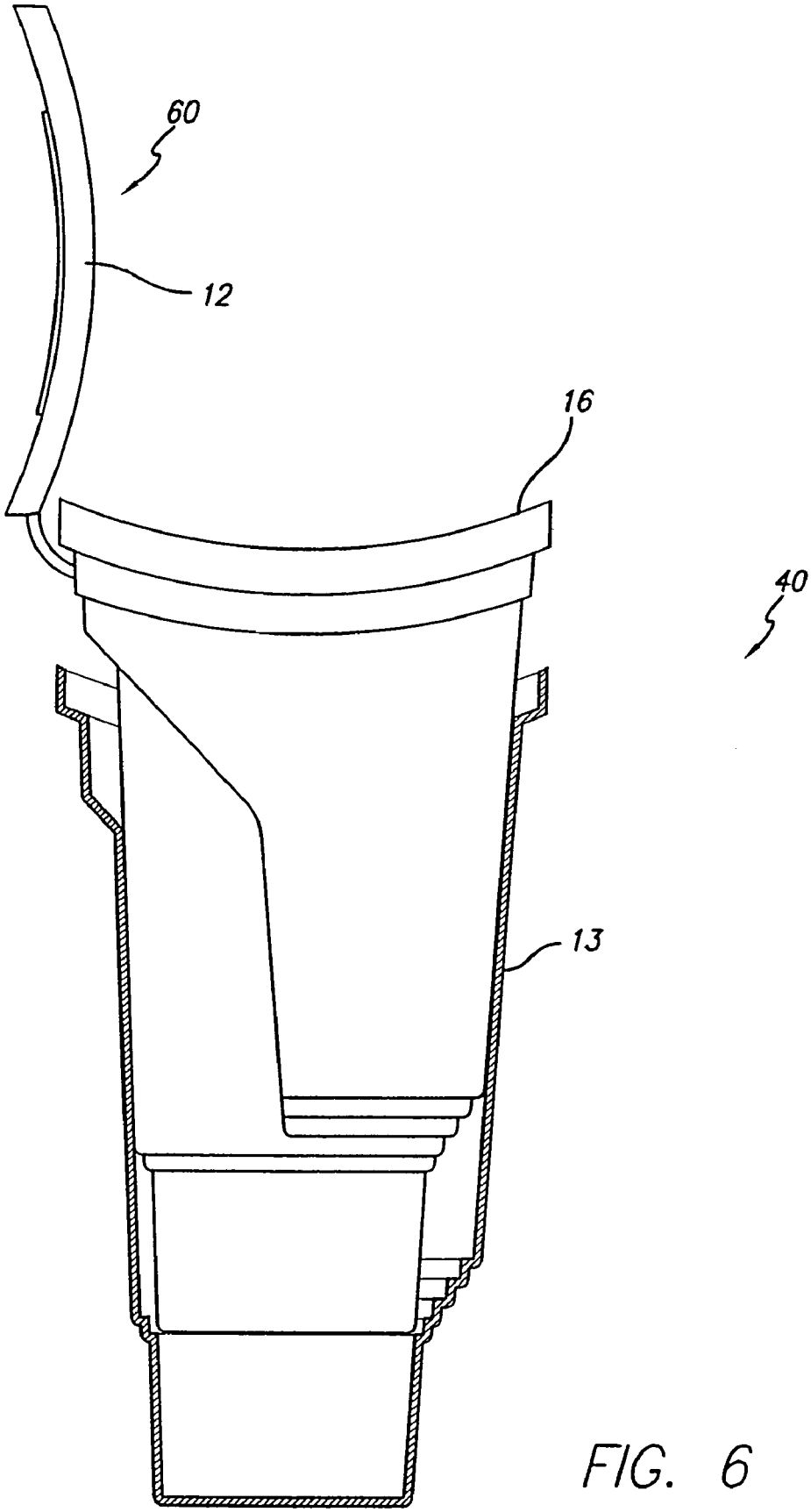
FIG. 6 is a side elevational view of two of the cups of FIG. 4 showing that they are nestable.

Referring to FIGS. 4-6, a second embodiment of a cup/lid combination is shown. Cup 40 is similar to cup 11, but has recess 17 omitted. Cup 40 is preferably a nestable variety. To this end cup 40 has a frustroconical wall 13 with a closed bottom 14 and an open top 15. The cup preferably has a thickened or rolled lip 16 at the open top 15.

In a preferred embodiment, cup 40 includes flexible tether 42 and band 44. The band 44 extends around the cup 40 preferably just under lip 16. The band 44, tether 42 and lid 12 together form a top for the cup 40. As shown in FIGS. 4 and 5, the tether 42 is connected at one end to the band 44 and at its opposite end to the lid 12. In an alternative embodiment, the tether 42 can be attached to or formed with the cup 40 itself, thus eliminating the need for band 44.

In an alternative embodiment, the band 44 is seated in a shallow channel that is formed in the side wall 13 of the cup 40. In a preferred embodiment, the channel can be omitted.

As is best shown in FIG. 4, in a preferred embodiment, the top 15 of cup 40 has a convex/concave shape. In other words, when viewed from one side (as shown in FIG. 6), the top 15 has a concave shape. When the cup 40 is turned 90 degrees from the position shown in FIG. 6 the top 15 has a convex shape. This configuration is referred to herein as a convex/concave shape and will be readily understood by those skilled in the art. After being stored for a period of time, lid 12 takes on a shape similar to that shown in FIGS. 4 and 5. This is because in storage, lid 12 points upwardly, as shown in FIG. 6. When the stack of cups 40 is placed in a sleeve, the lid 12 of a lower cup 40 typically contacts some of the cups 40 above it in the stack. Because the cups 40 are round and the cups 40 and lids 12 are secured in a sleeve, the lids 12 tend to mirror the shape of the cups, thus giving the lids 12 a convex/concave shape.

This convex/concave shape substantially corresponds to that of top 15 of cup 40 Therefore, the top 15 of cup 40 and lip 16 are preferably shaped in a non-flat or convex/concave shaped manner to accommodate the shape of lid 12 after storage. In an alternative embodiment, the lid 12 can have a convex/concave shape when manufactured. In this embodiment, the lid 12 and top 15 of cup 40 are both shaped so as to fit one another before the lid 12 is placed in the storage position (as described below).

In use, lid 12 is moved between a storage position 60 and a use position 62. As shown in FIG. 6, the lid 12 starts in the storage position 60. A user first removes the cup 40 from the stack. However, the tether 42 keeps the lid 12 attached to the lid 12, so that it does not drop to the floor, counter, etc. The user then fills the cup 40 with a beverage and places the lid 12 on the cup, which is referred to herein as the use position 62.

In a preferred embodiment, the band 44 is disposable. In this embodiment, after removing cup 40 from the stack, the user tears the tether 42, thereby separating the band 44 from the lid 12 and then places the lid 12 on the cup 40 in the use position 62. After the lid 12 is separated from the band 44, the band 44 can then be disposed of.

In yet another embodiment, the lid 12 can be stored inside cup 40. In use, the lid 12 is moved between a storage position, a filling position and a use position. It will be understood that the filling position is any position where the lid 12 is out of the cup 40 and not in the way when the cup 40 is being filled.

Preferably, the lid 12, band 44 and tether 42 are formed of a unitary piece of material. In an alternative embodiment, the lid 12, band 44 and tether 42 are formed of separate pieces that are attached to one another. Furthermore, the lid 12, band 44 and the tether 42 are preferably formed of thin wall flexible plastic materials thus enabling the lid 12 and tether to be bent and flexed when the lid is moved from the storage position to the use position. Also, the thin wall flexible plastic material allows for easy tearing of the tether in the embodiment where the band 44 is disposable. In another embodiment, where the band 44 is omitted, the lid 12, tether 42 and cup 40 are formed of a unitary piece of material.

Figure 7:
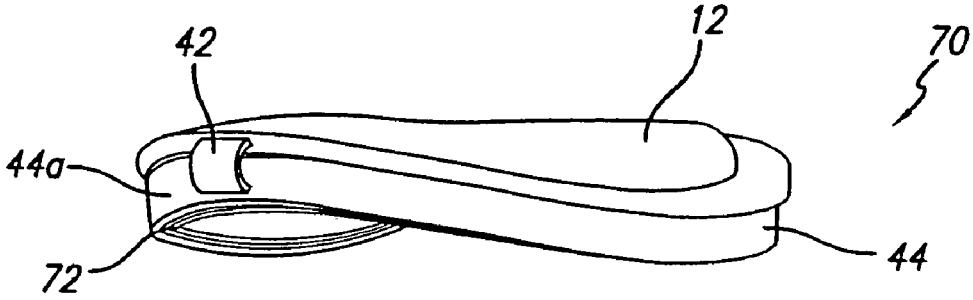
FIG. 7 is a perspective view of another embodiment of the present invention showing the top and lid without the cup.
Figure 8:
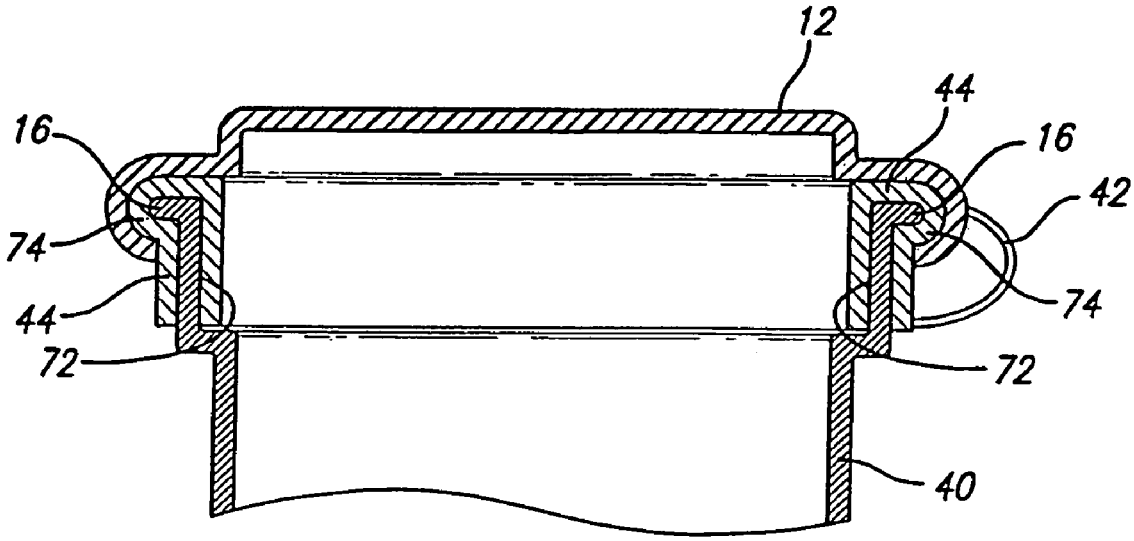
FIG. 8 is a cross-sectional view of a portion of a cup showing the top and lid of FIG. 7 secured on the lip of a cup.

A third preferred embodiment of the present invention is shown in FIGS. 7-8. In this embodiment, a top 70 includes a band 44 that is fitted around the lip 16, and a lid 12 that is connected to the band 44 by a tether 42. The band 44 includes a channel 72 for receiving the lip 16 of the cup 40. As can be seen in FIG. 8, the lip 16 of the cup 40 is received in the channel 72. The top 70 is preferably made of an elastomeric material, such as plastic or the like. Accordingly, the top 70 can be snap fit on the top 15 of the cup 40 by mating the channel 72 and the lip 16 of the cup 40. Preferably, the band 44 also includes a lip 74. In use, the lid 12, which is secured to the bottom portion 44*a* of the band 44 is snap fit onto the lip 74 of the band. As can be seen in FIG. 8, the channel 72 is defined in the bottom portion 44*a* of the band 44 and extends upwardly into the lip 74. In an alternative embodiment, the channel 72 can be defined only in the bottom portion 44*a* of the band 44. In this embodiment, the top 70 can be used on a cup without a lip and can therefore provide a lip for the cup and the capability of securing a lid thereon.

As can be seen in FIG. 7, in a preferred embodiment, the top 70 has a non-flat or convex/concave shape similar to that described above with respect to the second embodiment of the present invention. However, the top 70 can also have a flat configuration, as is shown in FIG. 8. It will be understood by those skilled in the art, that in this embodiment, the cup 40 can simply be a prior art cup that has the top 70 secured thereon.

In this embodiment, the tether 42 can be tearable or not. However, in the event that the tether 42 is torn, because the band 44 is secured around the lip 16, the tether 42 is not disposable as it is in the embodiment described above.

In use, the cups 40 come in a stack with the top 70 secured to the lip 16 of the cup. The lid 12 is in the open or storage position, so that the cups 40 can all fit in one another. A user pulls a cup 40 from the stack, fills the cup 40 and closes the lid 12, thus placing the lid 12 in the use position. This method is advantageous for both the user and the establishment selling the cup and/or drink. The user does not have to take a cup from one stack and a lid from a separate stack. Moreover, because the lid is already attached to the cup, there is little chance of lids being wasted. In other words, the user will not pull two lids accidentally from a stack and drop one on the floor. The user saves time and the establishment saves money and inventory.

Figure 9:
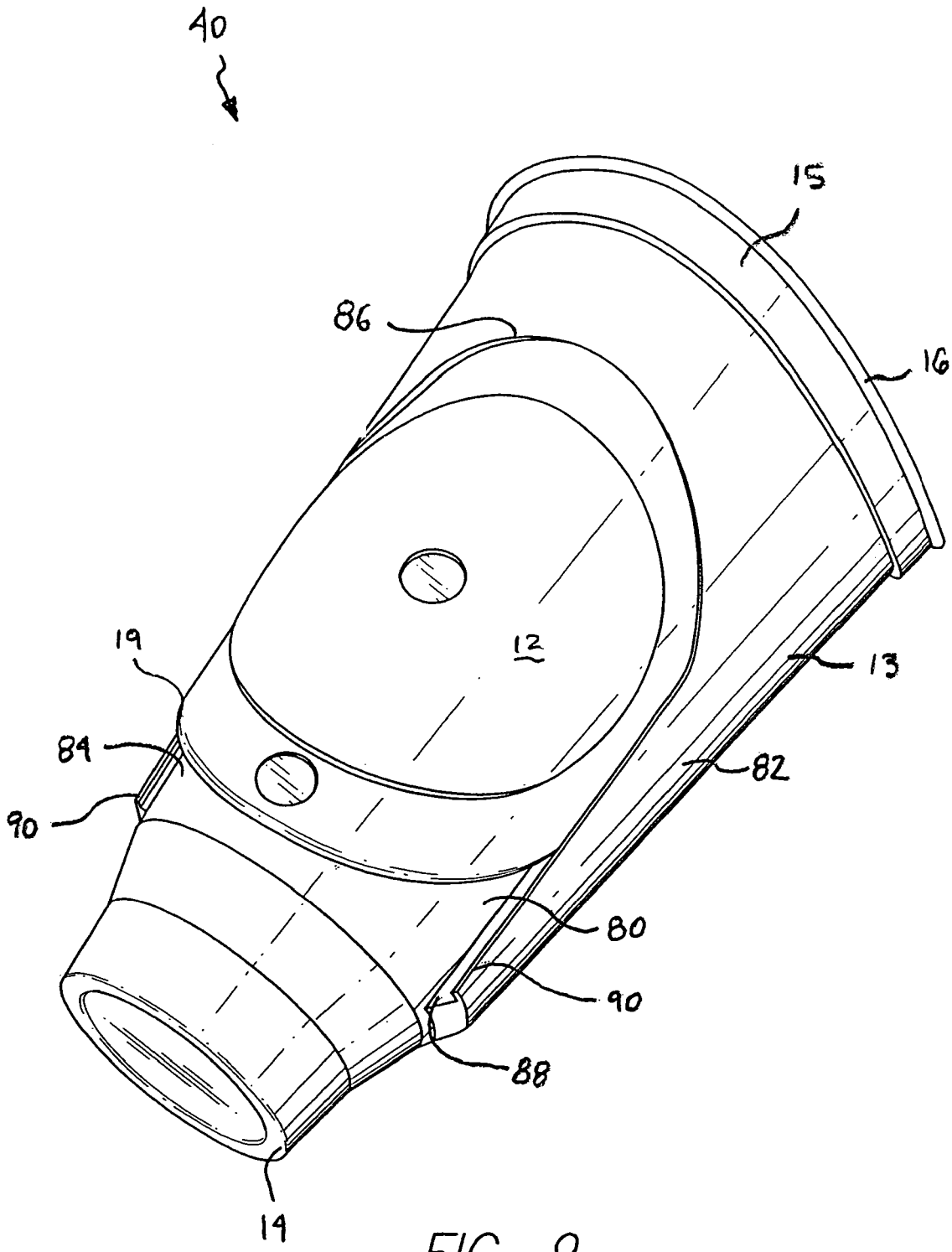
FIG. 9 is a perspective view of the cup/lid combination of FIG. 4, showing the lid retained in a slot portion on the side of the cup.
Figure 10:
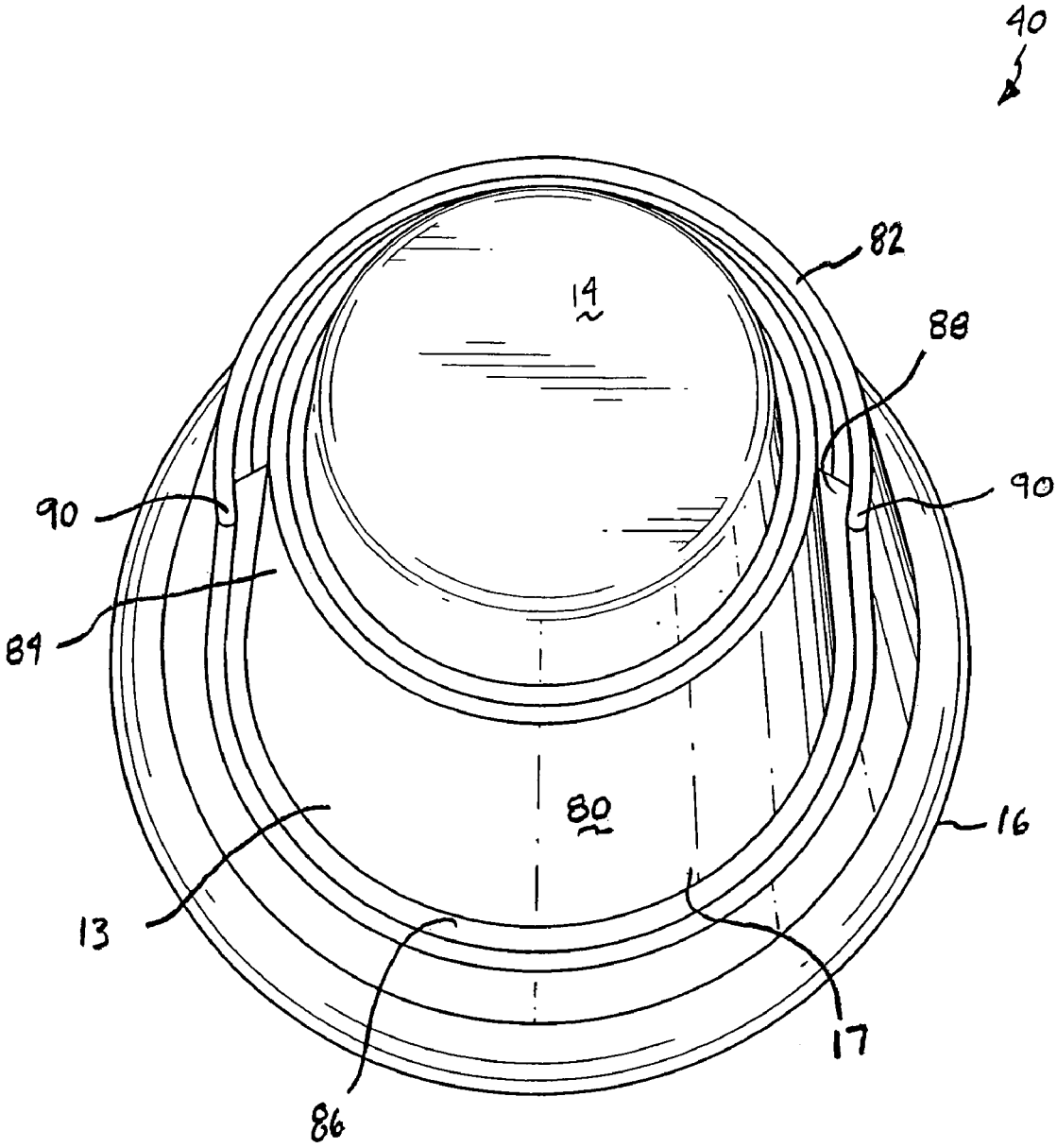
FIG. 10 is a bottom perspective view of the cup of FIG. 4 showing the slot portion without a lid therein.

FIGS. 9-10 show the cup 40 as shown in FIGS. 4-6, but without the tether 42 on the lid 12. As shown in FIGS. 4-6 and 9-10, instead of including a circular recess for retaining the lid 12, as is shown in the embodiment in FIGS. 1-3, the side wall 13 of the cup 40 has a slot portion 80 defined therein into which the lid 12 is slid so that it can be retained in the recess 17 in the side of cup 40. It will be understood that recess 17 is part of slot portion 80. As shown in FIG. 9, cup 40 includes a raised portion 82 and an indented portion 84 that cooperate to define the slot portion 80. The slot portion 80 includes a closed top 86 and an open bottom or mouth 88 into which the lid 12 is inserted and is then slid up into place in recess 17.

As is best shown in FIG. 10, the side wall, and in particular the raised portion 82 includes a flange 90 that extends into and partially defines the slot portion 80. This flange 90 is adapted to overlie and retain the periphery 19 of lid 12 when it is inserted through mouth 88, slid into slot portion 80 and secured in place against closed top 86, as is shown in FIG. 9. Similar to the embodiment shown in FIGS. 1-3, the slot portion 80 and/or recess 17 can also include one or more nubs which are adapted to overlie and retain the periphery 19 of the lid 12 when it is positioned within slot portion 80 and/or recess 17.

In a preferred embodiment, the flange 90 extends from raised portion 82 in such a manner that it is flush with the outer surface of raised portion 82. Such an arrangement allows for multiple cups 40 to be stacked with the lid 12 disposed in the slot portion 80, if so desired.

To store the lid 12, the lid 12 is flexed appropriately (so that it mimics the shape of the outer surface of side wall 13), and then inserted through mouth 88 under flange 90 and is slid into position in slot portion 80 and recess 17.

In use, the cups can come stacked with the lid 12 attached to a tether 42 and band 44 or in a stack with the lid 12 disposed in slot portion 80. If the lid 12 is attached to the tether, a user pulls a cup 40 from the stack, takes the band 44 off of the cup 44, tears the tether 42, discards the band 44, and then can either place the lid 12 on top of the cup 44 or can slide the lid 12 into the slot portion 80 for storage while filling or drinking from the cup. If the lid is already stored in the slot portion 80, the user pulls a cup 40 from the stack, slides the lid 12 out of slot portion 80 (through mouth 88), fills the cup 40 (these steps can be reversed) and places the lid on the lip 16 of the cup. This method is advantageous for both the user and the establishment selling the cup and/or drink. The user does not have to take a cup from one stack and a lid from a separate stack. Moreover, because the lid is already disposed in the slot portion of the cup, there is little chance of lids being wasted. In other words, the user will not pull two lids accidentally from a stack and drop one on the floor. The user saves time and the establishment saves money and inventory.

In an alternative embodiment, the slot portion can be defined in the side wall on the inside of cup. In another embodiment the slot portion can extend from the bottom of the cup to the top of the cup, thereby providing the capability of sliding the lid in from the top or the bottom. In another embodiment, the slot portion can extend horizontally. In another embodiment the mouth of the slot portion can be at the top of the cup. In another embodiment, the flange can extend over the slot portion, thereby covering the lid when it is in its storage position.

A fourth preferred embodiment of the present invention is shown in FIGS. 11-16. In this embodiment, the lid 12 and a cup 100 include a T-bar connection 102. The T-bar connection 102 comprises a connector 104 that extends from the lid 12 and a recess 106 in the cup 100. The connector 104 is removably received in the recess 106.

Figure 14:
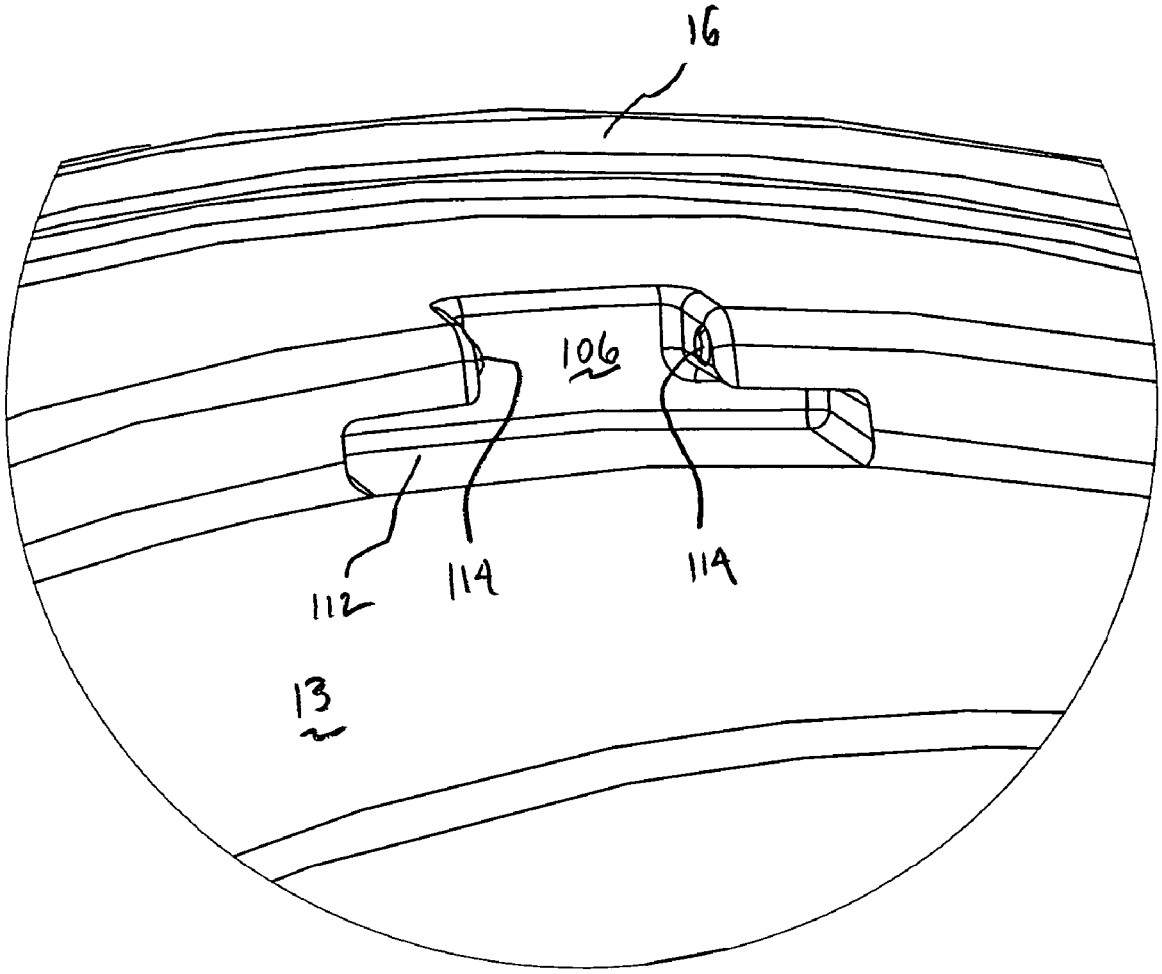
FIG. 14 is a detailed perspective view of the T-bar recess of the cup of FIG. 11.
Figure 16:
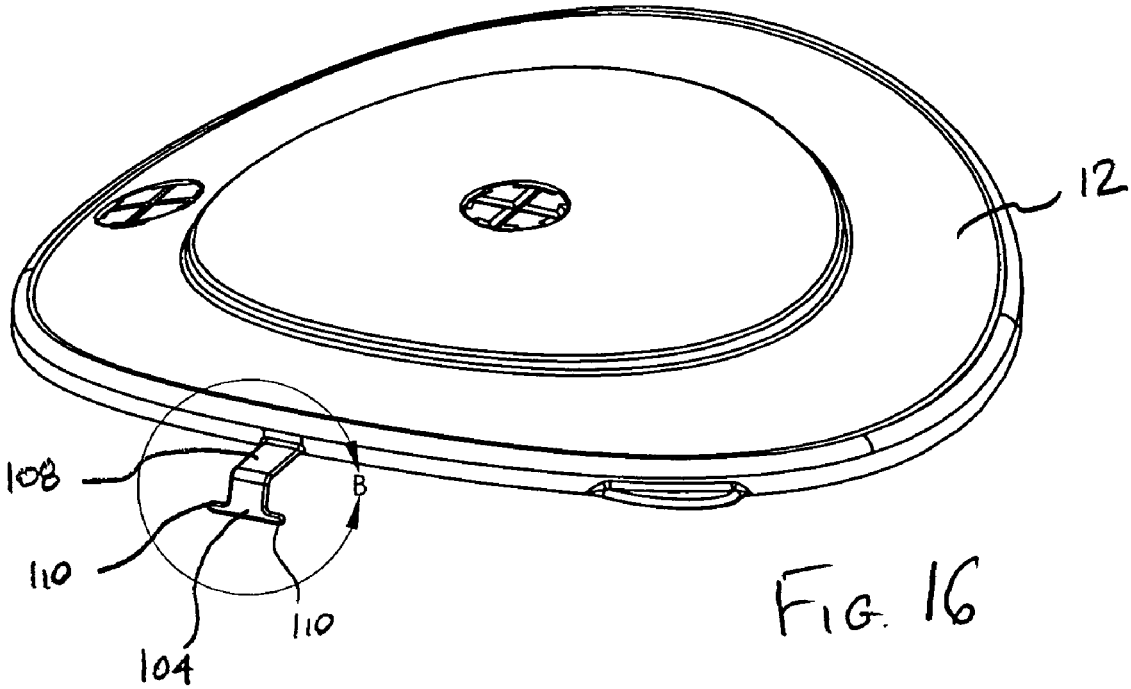
FIG. 16 is a perspective view of the lid of FIG. 11.
Figure 16A:
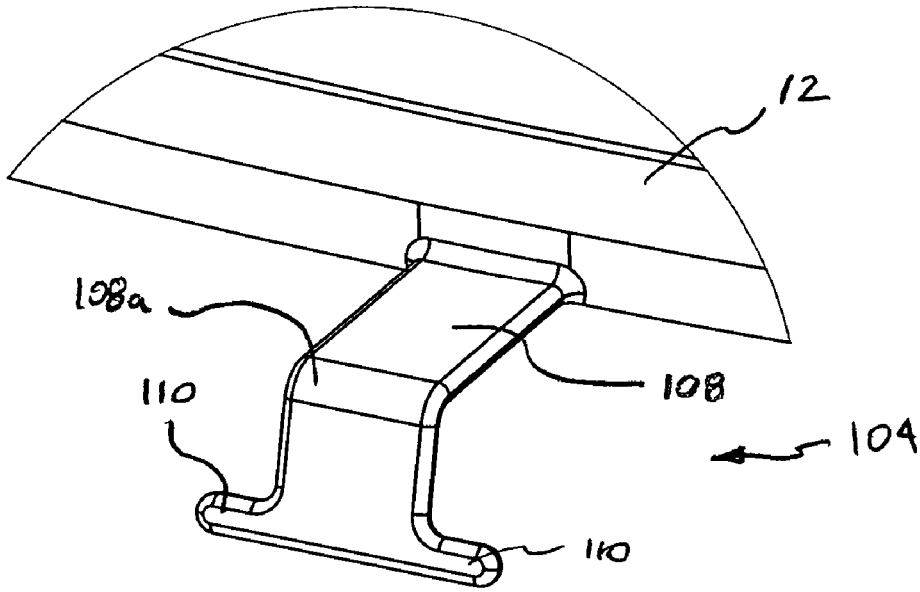
FIG. 16*a* is a detailed perspective view of the T-bar connector of the lid of FIG. 11.

As is best shown in FIGS. 16 and 16*a*, connector 104 includes an extension 108 that extends from lid 12, and a pair of pegs 110 that extend outwardly extension 108. In a preferred embodiment, extension 108 includes a bend 108*a* therein. However, this is not a limitation on the present invention. As is best shown in FIG. 14, recess 106 includes a wide portion 112 and a pair of knobs 114.

Figure 11:
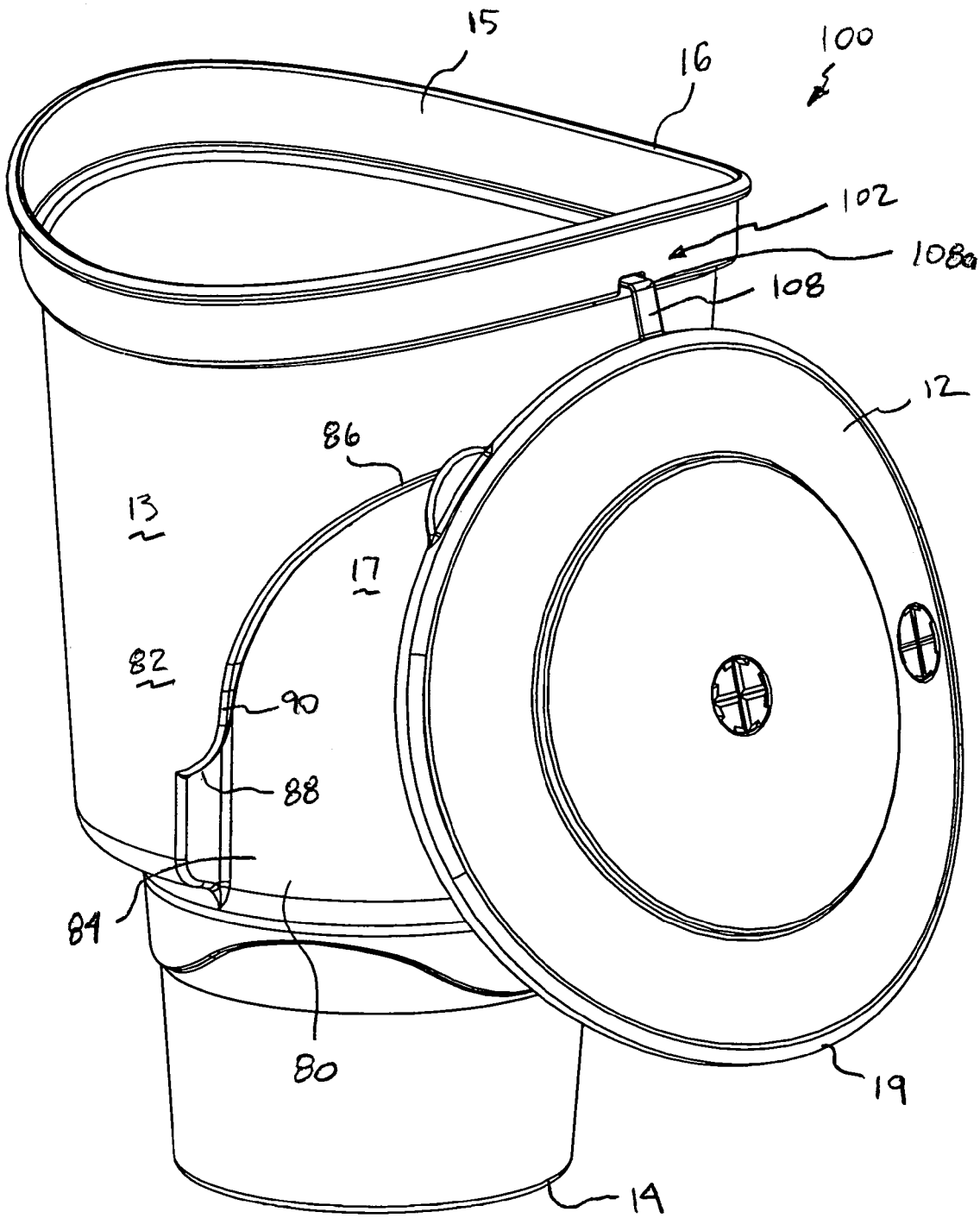
FIG. 11 is a perspective view of a cup and lid with a T-bar connection in accordance with another embodiment of the present invention.
Figure 12:
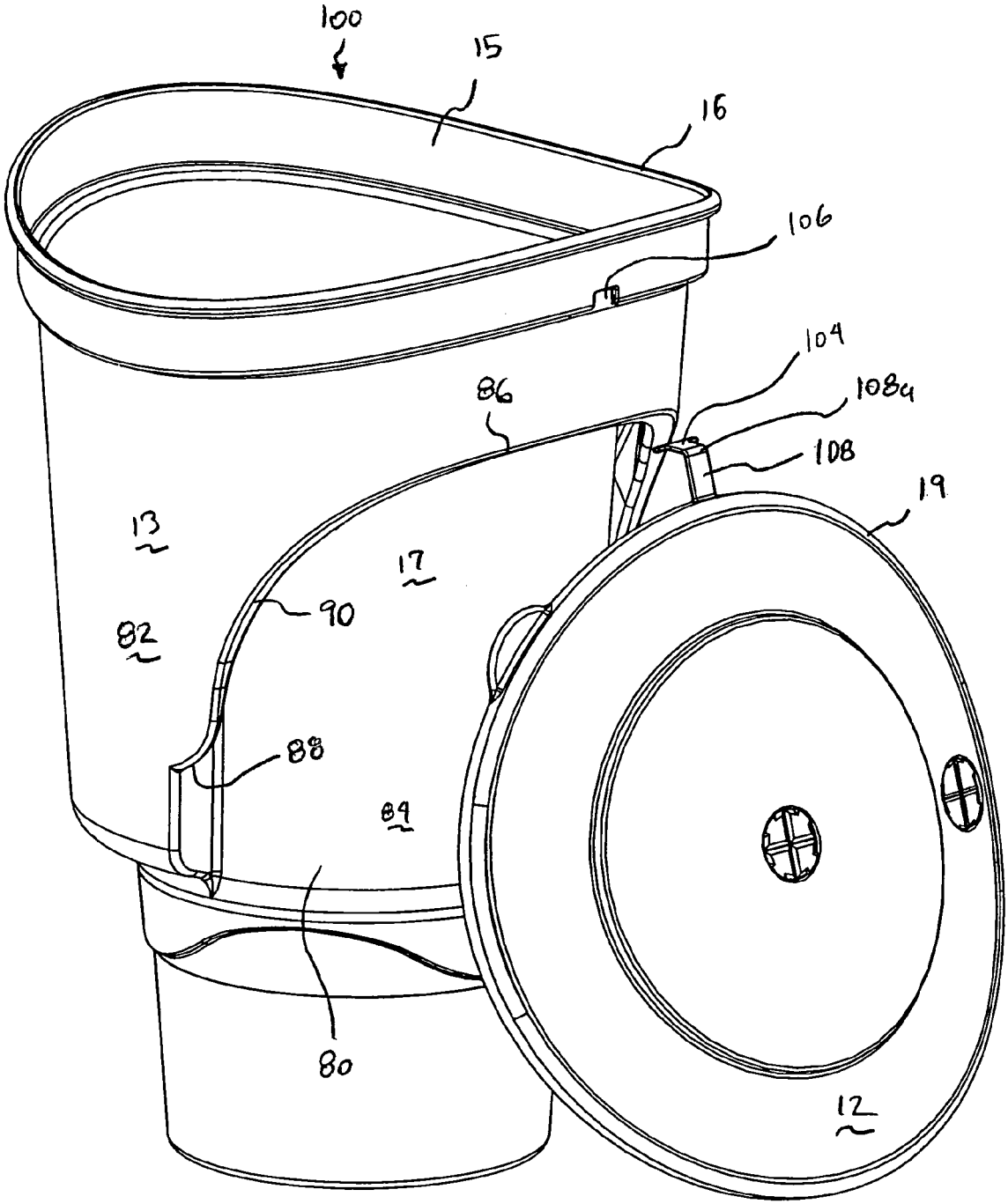
FIG. 12 is a perspective view of the cup and lid of FIG. 11 with the lid exploded from the cup.
Figure 13:
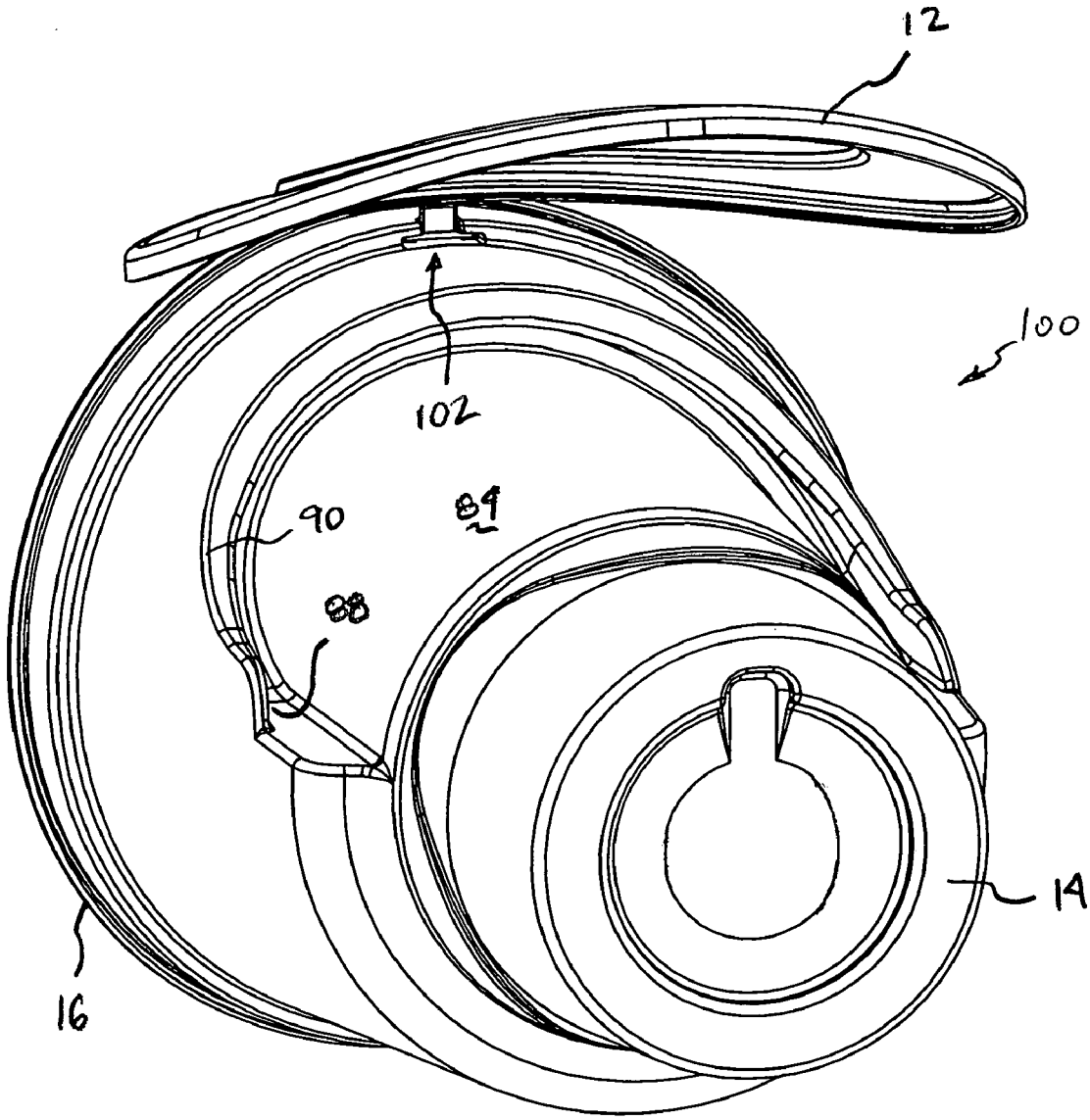
FIG. 13 is a bottom perspective view of the cup and lid of FIG. 11.
Figure 15:
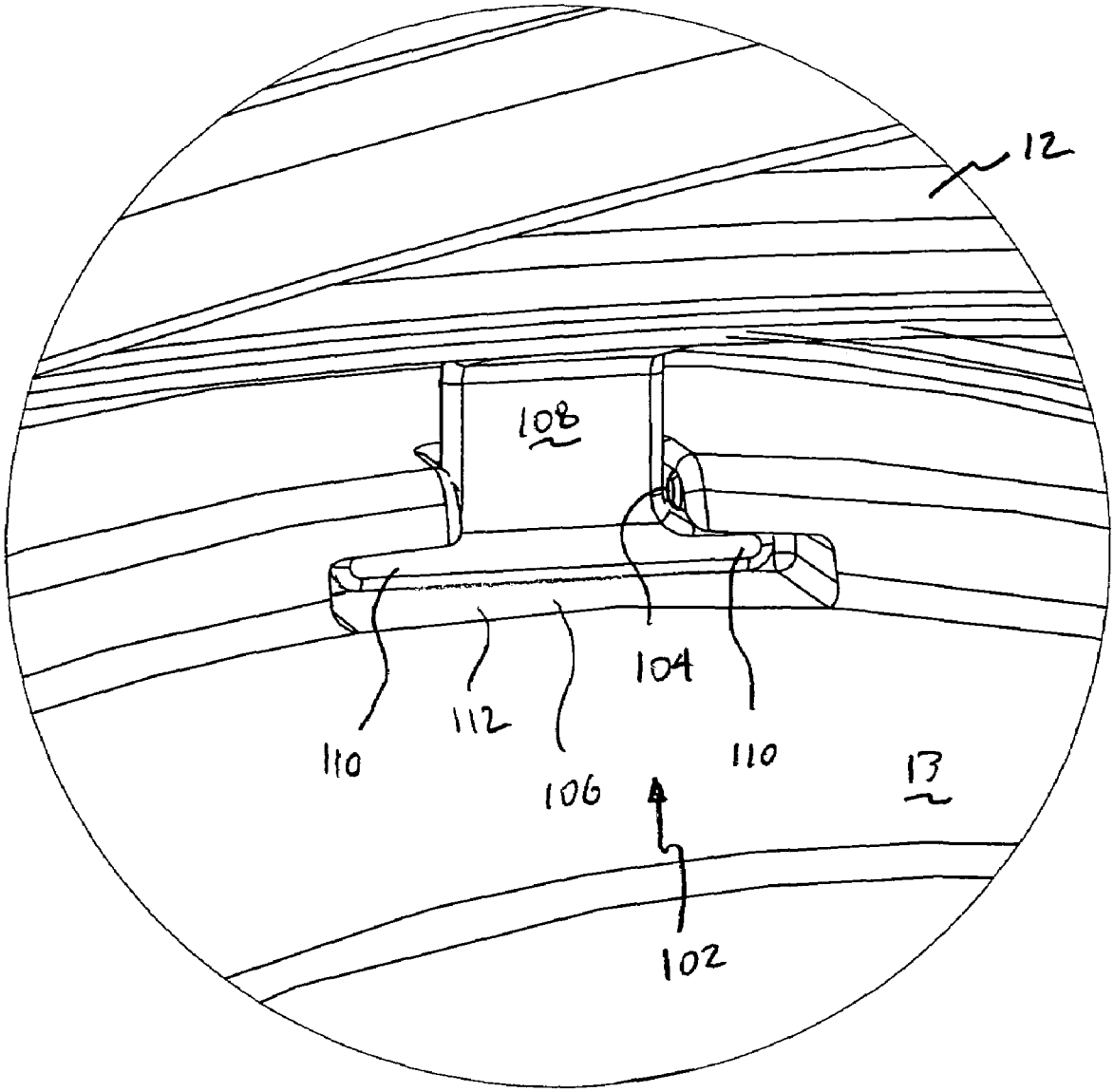
FIG. 15 is a detailed perspective view of the T-bar connector in the T-bar recess of the cup of FIG. 11.

With reference to FIGS. 11, 12 and 15, to establish the T-bar connection, the pegs 110 are inserted into the wide portion 112 of recess 106 and then the extension 108 is snapped past the knobs 114 an into place, as is shown in FIG. 15. It will be understood that the distance between the knobs 114 is less than the width of the extension 108. Because the extension 108 is made of a pliable material, it deforms as it is pressed past the knobs 104. To remove the connector 104 from the recess 106, the extension 108 is pulled back past the knobs 104. As is shown in FIG. 11, the bend 108*a* in extension 108 in combination with the location of the knobs 104 and the pegs 110 allows the lid 12 to rest in a downwardly extending position. This position is advantageous for stacking and dispensing of the cup 100 and lid 12 together.

As can be seen FIGS. 11-12, in a preferred embodiment, the cup 100 has a non-flat or convex/concave shape similar to that described above with respect to the second embodiment of the present invention. However, the top of cup 100 can also have a flat configuration. It will be understood by those skilled in the art, that in this embodiment, the cup 100 and lid 12 can simply be a prior art cup and lid that include the components of the T-bar connection 102. In this embodiment, the connector 104 can be tearable from lid 12 or not.

In an alternative embodiment, the knobs 104 can be omitted and the wide portion 112 can include knobs or the like into which the pegs 110 can be snap fit.

A fifth preferred embodiment of the present invention is shown in FIGS. 17-23. In this embodiment, the lid 12 and a cup 120 include a snap fit connection 122. The snap fit connection 122 comprises a connector 124 that extends from the lid 12 and a recess 126 in the cup 120. The connector 124 is removably received in the recess 126.

As is best shown in FIGS. 19-23, connector 124 includes an extension 128 that extends from lid 12, and a U-shaped member 130 that extends outwardly from extension 128. The U-shaped member 130 includes two elongated ridges 130*a* on an inside surface thereof. In a preferred embodiment, extension 128 includes a bend 128*a* therein. However, this is not a limitation on the present invention. As is best shown in FIG. 14, recess 126 includes a protrusion 132 that has a pair of indentations 134 defined therein.

With reference to FIGS. 19-22, to establish the snap fit connection, the U-shaped member 130 is pressed over the protrusion 132. Due to the material of the U-shaped member, the elongated ridges 130*a* cause the U-shaped member to spread until the elongated ridges 130*a* snap into place in the indentations 134. It will be understood that the distance between the elongated ridges 130*a* is less than the width of the protrusion 132. To remove the connector 124 from the recess 126, the extension U-shaped member 130 is pulled backwards so that the elongated ridges 130*a* come out of the indentations 134 and U-shaped member 130 comes off of protrusion 132. In a preferred embodiment, protrusion 132 also includes a blocker 136 for preventing the connector 104, and specifically U-shaped member 130 from being pulled downwardly and sliding off of protrusion 132 and out of recess 126.

Figure 17:
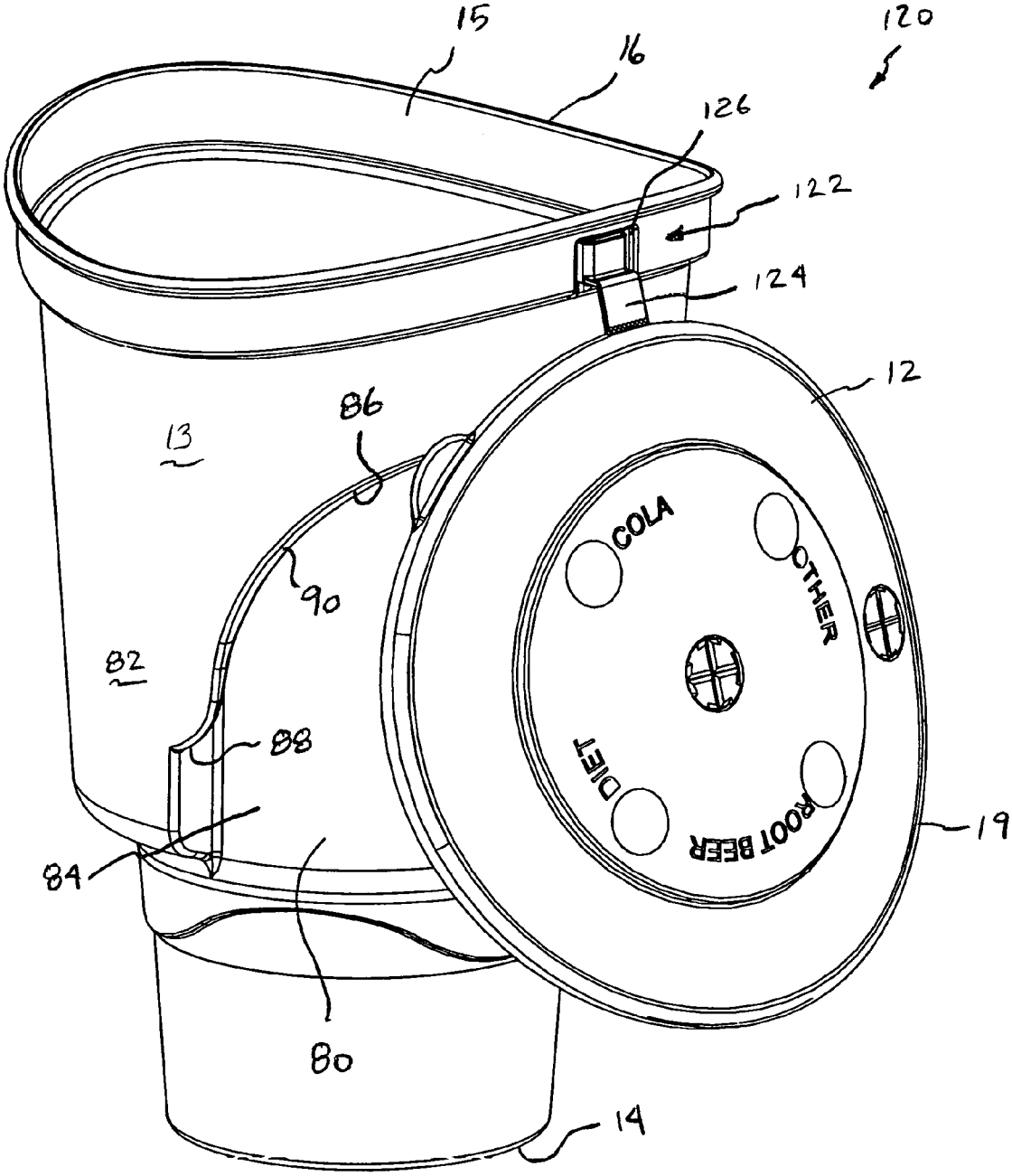
FIG. 17 is a perspective view of a cup and lid with a snap fit connection in accordance with another embodiment of the present invention.

As is shown in FIG. 17, the bend 128*a* in extension 128 allows the lid 12 to rest in a downwardly extending position. This position is advantageous for stacking and dispensing of the cup 120 and lid 12 together.

Figure 18:
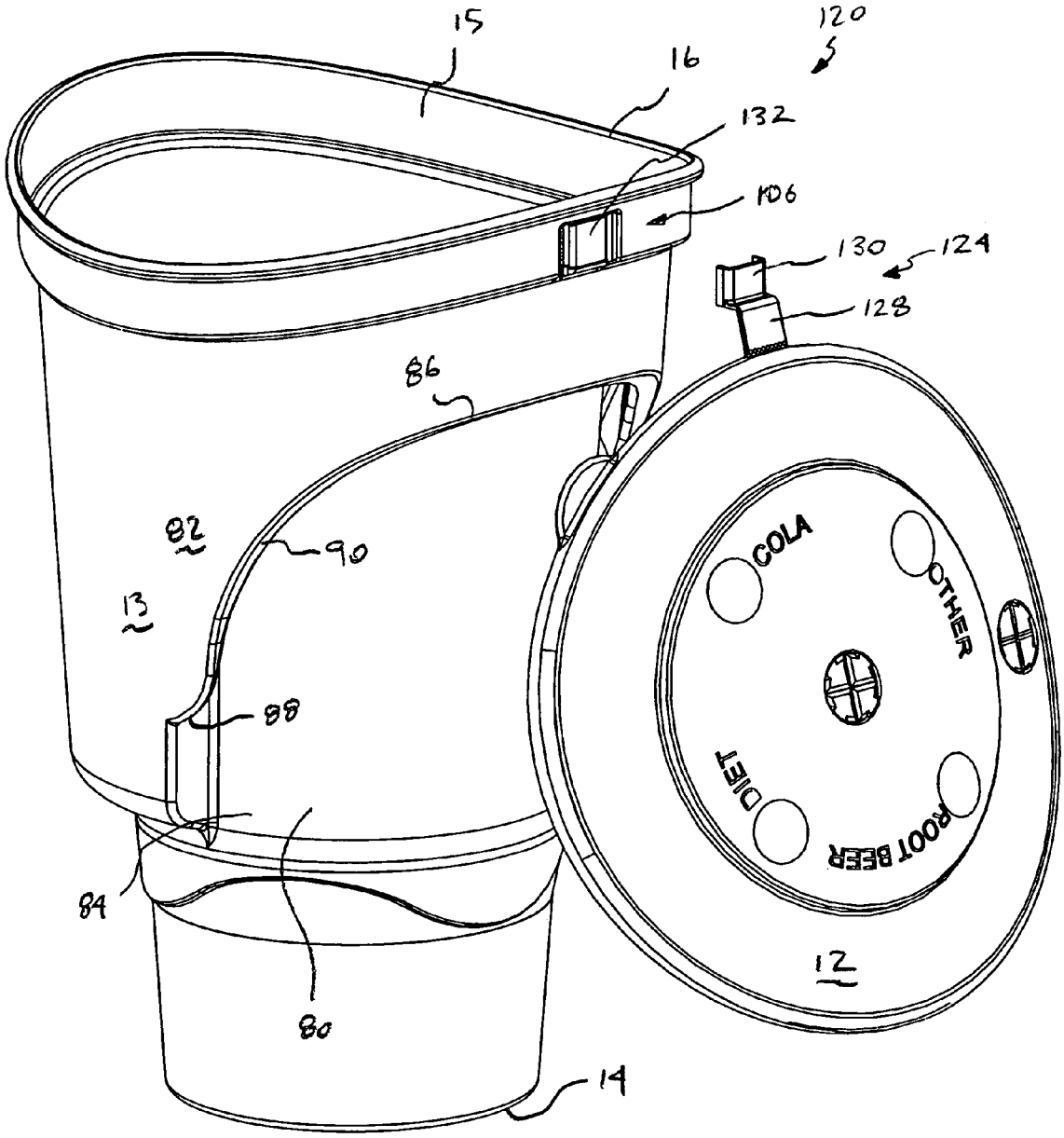
FIG. 18 is a perspective view of the cup and lid of FIG. 17 with the lid exploded from the cup.
Figure 19:
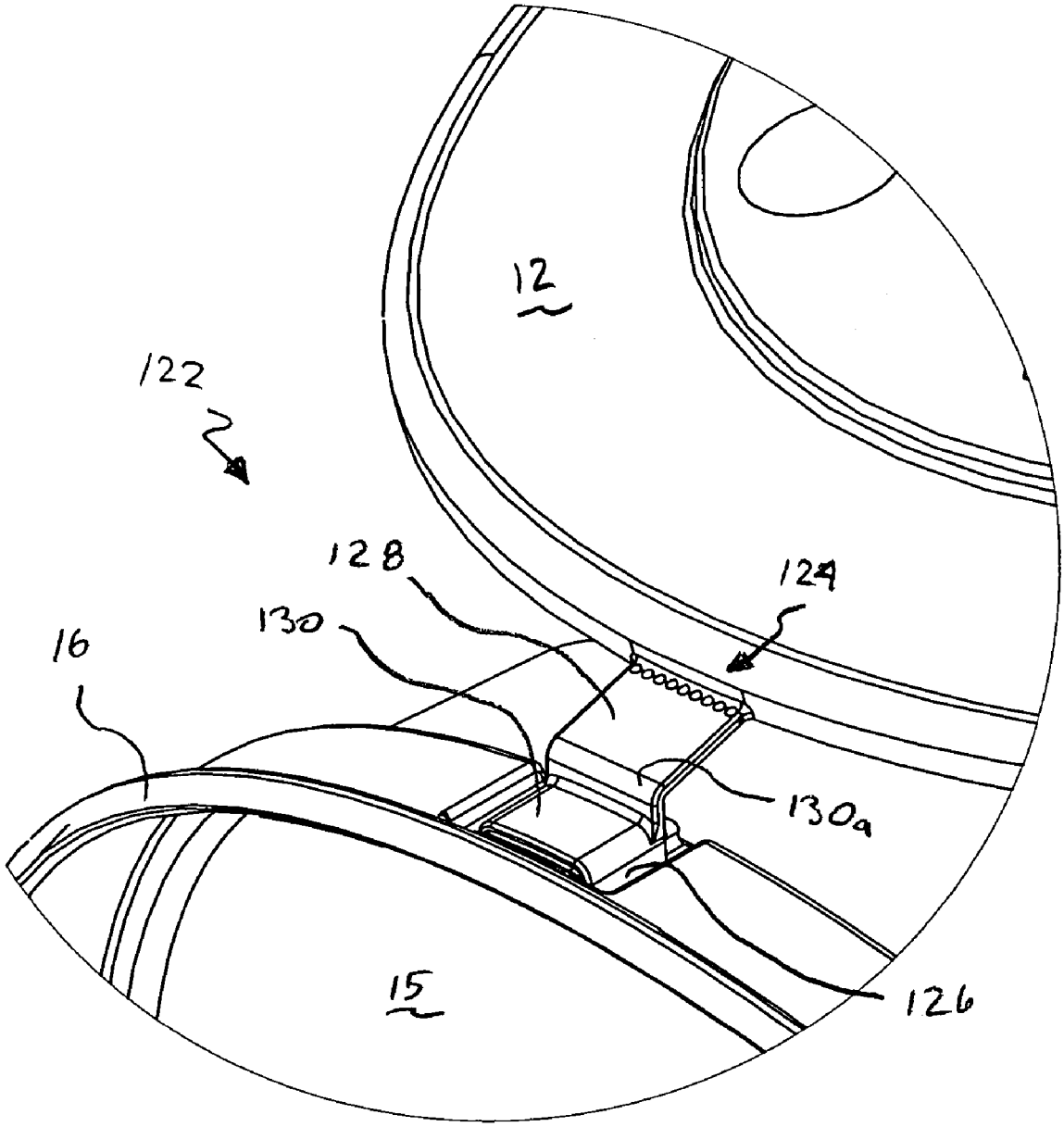
FIG. 19 is a detailed perspective view of the snap fit connection of the lid and cup of FIG. 17.
Figure 20:
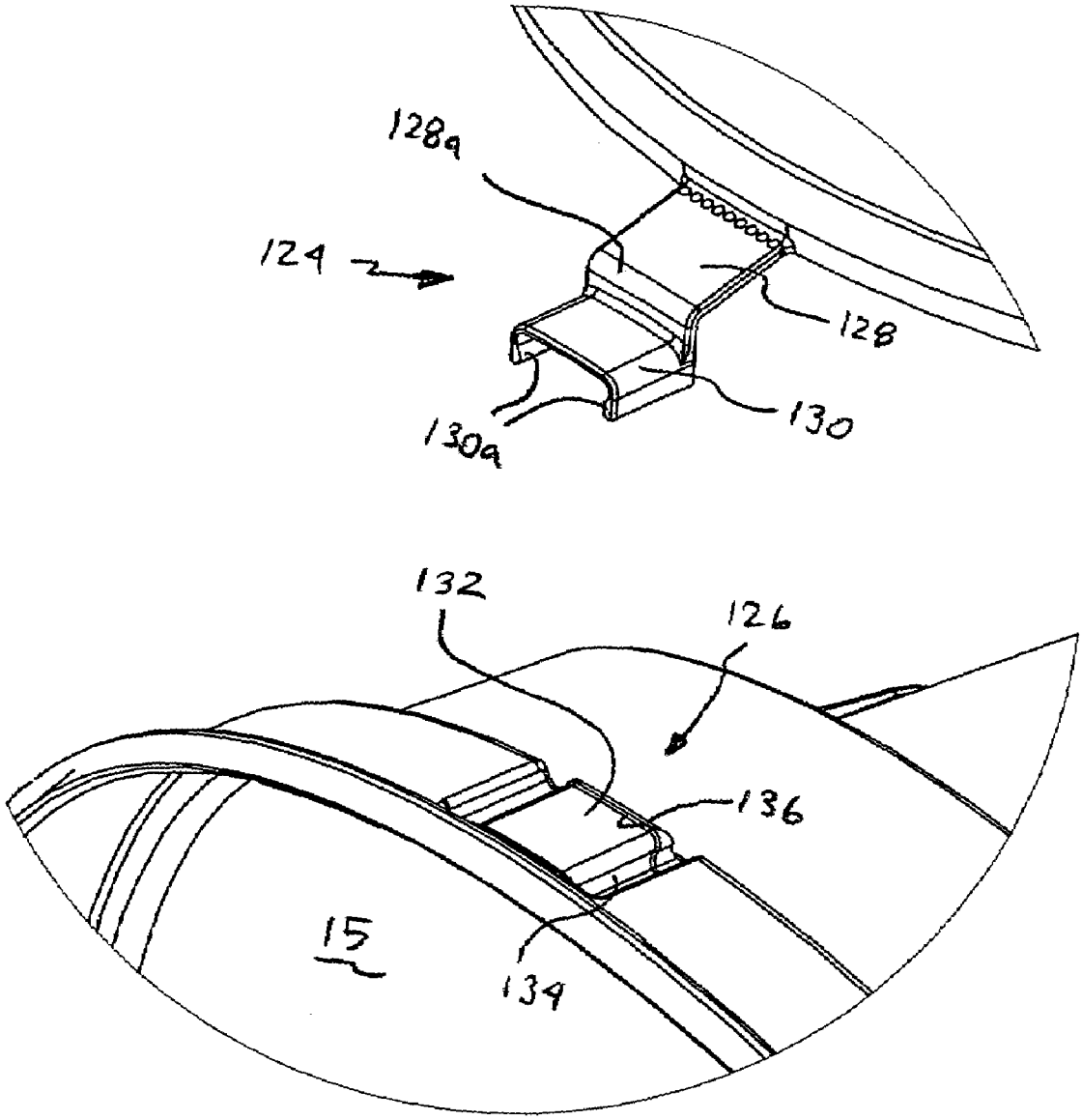
FIG. 20 is a detailed perspective view of the cup and lid of FIG. 17 with the lid exploded from the cup.
Figure 21:
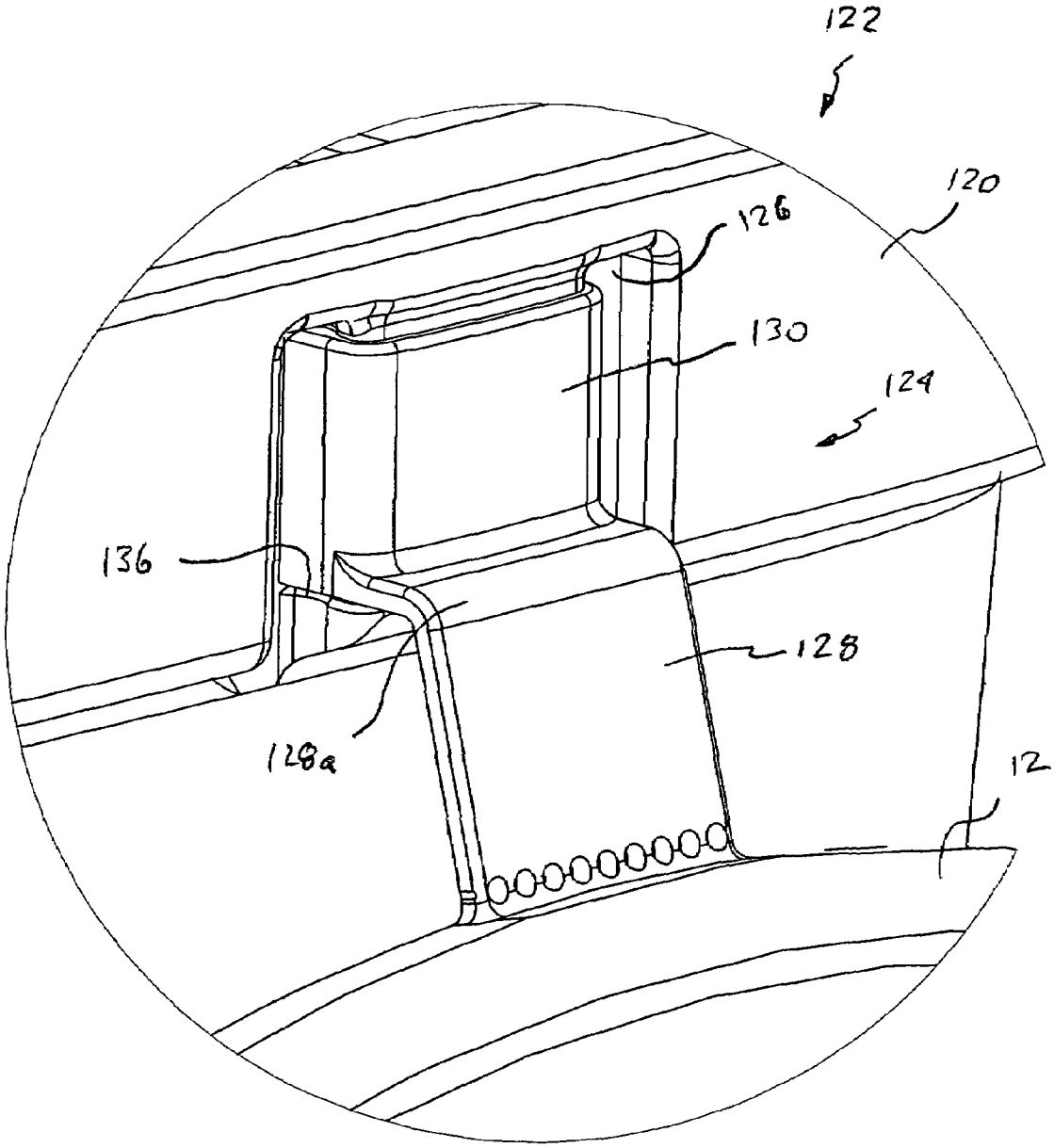
FIG. 21 is another detailed perspective view of the snap fit connection of the lid and cup of FIG. 17.
Figure 22:
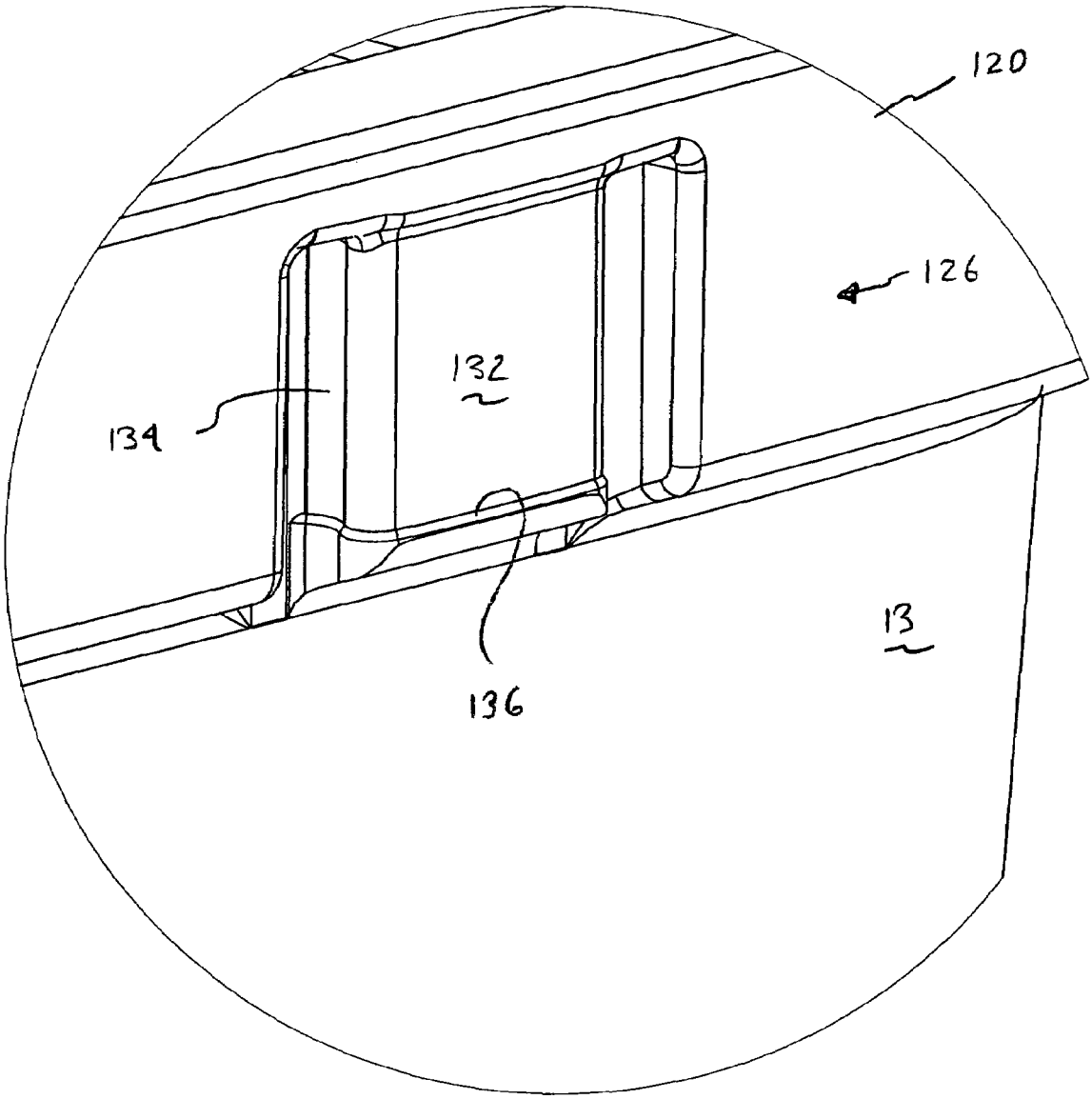
FIG. 22 is a detailed perspective view of the snap fit recess of the cup of FIG. 17.
Figure 23:
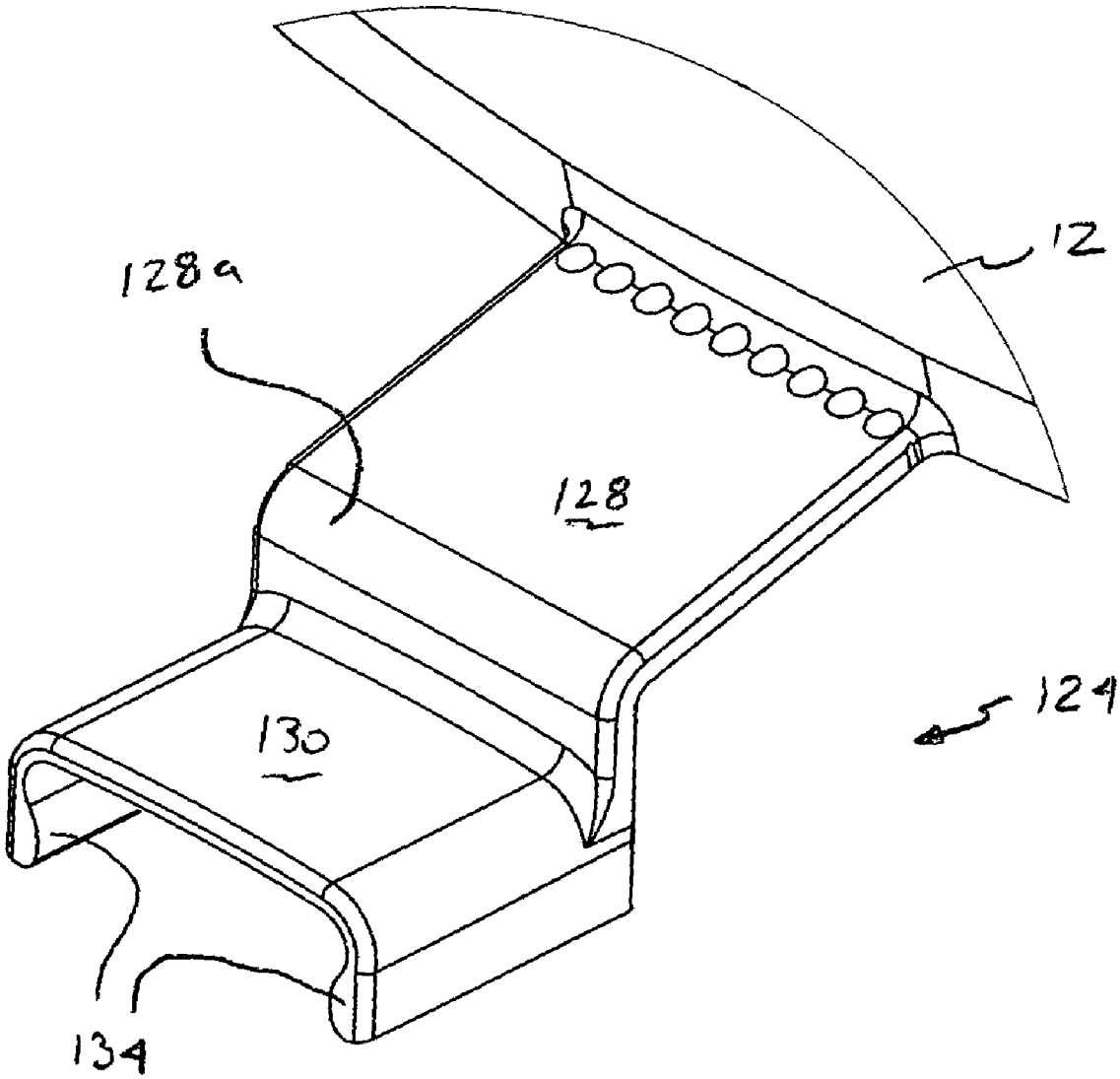
FIG. 23 is a detailed perspective view of the snap fit member of the lid of FIG. 17.

As can be seen FIGS. 17-18, in a preferred embodiment, the cup 120 has a non-flat or convex/concave shape similar to that described above with respect to the second embodiment of the present invention. However, the top of cup 120 can also have a flat configuration. It will be understood by those skilled in the art, that in this embodiment, the cup 120 and lid 12 can simply be a prior art cup and lid that include the components of the snap fit connection 122. In this embodiment, the connector 124 can be tearable from lid 12 or not.

It will be appreciated by those skilled in the art that other temporary connections between the cup and lid are within the scope of the present invention. Any connection that includes a connector extending from the lid and a recess in the cup or vice versa is within the scope of the invention. For example, VELCRO™, buttons, other snap fit connections or the like are possible.

The embodiments described above are exemplary embodiments of the present invention. Those skilled in the art may now make numerous uses of, and departures from, the above-described embodiments without departing from the inventive concepts disclosed herein. Accordingly, the present invention is to be defined solely by the scope of the following claims.

What is claimed is:

1. A cup and lid in combination, the cup comprising a side wall, a closed bottom and an open top having a lip and the lid includes a downwardly depending portion adapted to be secured around the lip, wherein the side wall includes a recess defined therein and the lid includes a connector extending outwardly therefrom, wherein the recess includes a protrusion that has a pair of indentations defined on opposed sides thereof and wherein the connector includes a U-shaped member that has elongated ridges on an inside surface thereof that are received in the indentations on the protrusion, and wherein the connector can be disconnected from the cup.

2. The cup and lid combination of claim 1 wherein the recess is defined adjacent to the open top of the cup.

3. The cup and lid combination of claim 1 wherein the side wall includes an indented portion and a raised portion, wherein the raised portion and the indented portion cooperate to define a slot portion that is adapted to receive the lid, and wherein the top of the cup has a convex/concave shape.

4. The cup and lid combination of claim 1 wherein the protrusion includes a blocker that abuts a bottom edge of the U-shaped member.

5. The cup and lid combination of claim 1 wherein the side wall includes an indented portion and a raised portion, wherein the raised portion and the indented portion cooperate to define a slot portion that is adapted to receive the lid.

6. The cup of claim 1 wherein the top of the cup has a convex/concave shape.

7. A cup and lid in combination, the cup comprising a side wall, a closed bottom and an open top having a lip and the lid includes a downwardly depending portion adapted to be secured around the lip, wherein the side wall includes a recess defined therein, and the lid includes a connector extending outwardly therefrom, wherein the connector is temporarily secured in the recess and the lid and connector can be disconnected from the cup, wherein the recess includes a pair of opposed knobs that define a distance therebetween and wherein the connector includes an extension having a width, wherein the width of the extension is less than the distance between the opposing knobs.

8. The cup and lid combination of claim 7 wherein the extension includes a pair of pegs extending outwardly therefrom and wherein the recess includes a wide portion into which the pegs are received.

9. A method of placing a lid on a cup, the method comprising the steps of:

providing a stack of nestable cups and lids, at least one of the cups including a side wall, a closed bottom and an open top, wherein the side wall has a first connector thereon, and wherein the lid has a second connector extending outwardly therefrom that is temporarily connected to the first connector, removing the at least one cup from the stack, disconnecting the first and second connectors, thereby separating the lid and second connector from the cup, and placing the lid on the top of the cup.

10. The method of claim 9 wherein the first connector is located in a recess defined adjacent to the open top of the cup.

11. The method of claim 9 wherein the recess includes a pair of opposed knobs that define a distance therebetween and wherein the second connector includes an extension having a width, wherein the width of the extension is less than the distance between the opposing knobs, and wherein the step of disconnecting the first and second connectors includes pulling the extension past the knobs.

12. The method of claim 9 wherein the first connector includes a protrusion, and wherein the step of disconnecting the first and second connectors includes pulling the second connector off of the protrusion.

13. The method of claim 12 wherein the protrusion has a pair of indentations defined on opposed sides thereof, and wherein the second connector includes a U-shaped member that has elongated ridges on an inside surface thereof that are received in the indentations on the protrusion.

14. The method of claim 9 wherein the side wall has a slot portion defined therein and wherein the method further comprises the step of sliding the lid into the slot portion.

15. The method of claim 9 further comprising the step of tearing the connector from the lid.

16. A cup assembly comprising:

a cup comprising a side wall, a closed bottom and an open top, wherein the side wall includes a first connector thereon that includes a protrusion, wherein the protrusion has a pair of indentations defined on opposed sides thereof, and a lid comprising a second connector extending therefrom that is releasably connected to the side wall of the cup by the first connector, wherein the second connector includes a U-shaped member that has elongated ridges on an inside surface thereof that are received in the indentations on the protrusion, wherein the first and second connectors can be disconnected.

* * * * *